United States Patent [19]

Hinata et al.

[11] 4,047,964

[45] Sept. 13, 1977

[54] SPECTRALLY SENSITIZED SILVER HALIDE PHOTOGRAPHIC EMULSION

[75] Inventors: Masanao Hinata; Haruo Takei; Akira Sato; Akira Ogawa, all of Minami-ashigara, Japan

[73] Assignee: Fuji Photo Film Co., Ltd., Minami-ashigara, Japan

[21] Appl. No.: 625,356

[22] Filed: Oct. 23, 1975

[30] Foreign Application Priority Data

Oct. 23, 1974 Japan ..... 49-122679

[51] Int. Cl.[2] ..... G03C 1/08; G03C 1/14

[52] U.S. Cl. ..... 96/126; 96/100 R; 96/122; 96/139; 96/140

[58] Field of Search ..... 96/122, 126, 140

[56] References Cited

U.S. PATENT DOCUMENTS 3,071,467 1/1963 Rauch ..... 96/140

*Primary Examiner*—J. Travis Brown

*Attorney, Agent, or Firm*—Sughrue, Rothwell, Mion, Zinn and Macpeak

[57] ABSTRACT

A supersensitized silver halide photographic emulsion which contains at least one dye of the formula:

wherein $Z^1$ represents the atoms necessary to complete a benzisoxazole ring; $Q^1$ represents the atoms necessary to complete a 2-thiooxazolidine-2,4-dione ring, a rhodanine ring or a 2-thiohydantoin ring; and $R^1$ represents an aliphatic group, in combination with at least one cyanine dye or merocyanine dye which contains no benzisoxazole ring.

31 Claims, 5 Drawing Figures

SPECTRALLY SENSITIZED SILVER HALIDE PHOTOGRAPHIC EMULSION

BACKGROUND OF THE INVENTION

1. Field of the Invention

This invention relates to a silver halide photographic emulsion and more particularly to a silver halide photographic emulsion spectrally sensitized with a combination of sensitizing dyes.

2. Description of the Prior Art

Various methods have been known for the spectral sensitization of silver halide photographic emulsions. Various sensitizing dyes have been employed for their spectral sensitization in the red, green or blue regions of the spectrum. Among the sensitizing dyes, merocyanine dyes have often been employed for spectral sensitization in the green and blue regions of the spectrum.

In photographic light-sensitive materials for graphic art use, particularly the so-called "lith type" light-sensitive materials, which are used for the production of halftone dots from originals with continuous tone employing a contact screen, merocyanine dyes have been employed for their spectral sensitization in the blue and red regions of the spectrum (for example, see U.S. Pat. Nos. 3,625,698, 3,480,439, 3,567,458, 2,519,001, 3,698,910, 3,703,377, 2,493,748, 2,493,747 and 2,497,876, Japanese Patent Publications 18,106/71, 18,105/71 and 549/71, U.S. Pat. Nos. 3,765,900 and 3,765,901, and Offenlegungschrifts 2,135,412, 2,101,071 and 2,057,034).

For the panchromatic sensitization of light-sensitive materials of this type, combinations of red-sensitive cyanine dyes and dimethine merocyanine dyes have mostly been employed (for example, see U.S. Pat. Nos. 3,808,009 and Offenlegungschrift 2,101,071). This is because merocyanine dyes can render silver chloride emulsions highly sensitive and can increase gradation (so-called contrast), which is advantageous for the production of lith type light-sensitive materials.

Spectral sensitization using merocyanine dyes is, however, by no means satisfactory. That is, it is very difficult to increase blue sensitivity using merocyanine dyes as mentioned above, in spite of intensive investigation. Green sensitivity is often lowered when hitherto known combinations of dimethine merocyanine dyes and simple merocyanine dyes (e.g., those described in Offenlegungschrift 2,101,071) are employed in order to improve blue sensitivity. Red sensitivity is often lowered when merocyanine dyes are employed in combination with red-sensitive thiacarbocyanine or selenacarbocyanine dyes. Namely, though merocyanine dyes are excellent sensitizing dyes for spectral sensitization in the blue or green regions of the spectrum, few combinations of merocyanine dyes and other sensitizing dyes with different structures having a remarkable synergistic effect or supersensitizing relation are known, and such combinations have only a weak effect.

Spectral sensitization using merocyanine dyes has hitherto also been insufficient with respect to other properties such as color stain. With the recent expansion of processing systems using automatic processors, fixing and washing have been carried out at minimum times, and hence color stain is liable to remain after development, which requires spectral sensitization techniques using dyes which leave minimal color stains and techniques which reduce color stain. In addition, spectral sensitization using dyes has also been insufficient with respect to the stability of the light-sensitive materials after production, that is, with respect to the sensitization, desensitization, increase in fog and, in the case of color photographic emulsions employing color couplers, reduction in green sensitivity with the passage of time.

SUMMARY OF THE INVENTION

It is therefore an object of this invention to provide a spectrally sensitized silver halide photographic emulsion having improved red sensitivity.

It is another object of this invention to provide a spectrally sensitized silver halide photographic emulsion having improved green sensitivity.

It is another object of this invention to provide a silver halide photographic emulsion having improved sensitivity to both red and green light which is suited for use in lith type light-sensitive materials.

It is a further object of this invention to provide a silver halide photographic emulsion suited for the production of medical X-ray photographic materials having improved sensitivity to the green emissions of fluorescent substances and having increased gradation.

It is a still further object of this invention to provide spectrally sensitized silver halide photographic emulsions suited for the recording of cathode ray tube display systems and having reduced reciprocity law failure at high illuminations and short exposure times.

It is another object of this invention to provide a spectrally sensitized silver halide photographic emulsion suited for rapid processing systems having reduced color stain, which is substantially not subject to interfering effects of additives such as anti-foggants and development promotors.

It is another object of this invention to provide a spectrally sensitized silver halide photographic emulsion for use in microphotographic light-sensitive materials having improved sensitivity to white light.

It is a further object of this invention to provide a silver halide photographic emulsion having reduced lowering of sensitivity due to the simultaneous use of sensitizing dyes with color couplers.

It is a still further object of this invention to provide a spectrally sensitized silver halide photograhic emulsion having reduced changes in sensitivity with the passage of time.

These and other objects of the invention are attained by incorporating in a silver halide emulsion a supersensitizing amount of a dye combination comprising at least one dye represented by the following general formula (I):

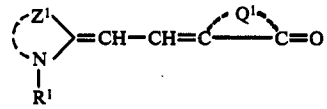

(I)

wherein $Z^1$ represents the atoms necessary to complete a benzisoxazole ring; $R^1$ represents an aliphatic group (which term includes substituted and unsubstituted aliphatic groups), the carbon chain of which may be interrupted by an oxygen atom or a sulfur atom, containing 1 to 8 carbon atoms, preferably 1 to 4 carbon atoms; and $Q^1$ represents the atoms necessary to complete a 2-thiooxazolidine-2,4dione ring, a rhodanine ring or a 2-thiohydantoin ring, in combination with at least one cyanine dye or merocyanine dye other than those represented by general formula (I). The cyanine dyes useful have a maximum sensitivity peak at a wavelength less than 700 nm while the merocyanine dyes useful have a maximum sensitivity peak at a wavelength less than 600 nm.

DETAILED DESCRIPTION OF THE INVENTION

Figure 1:
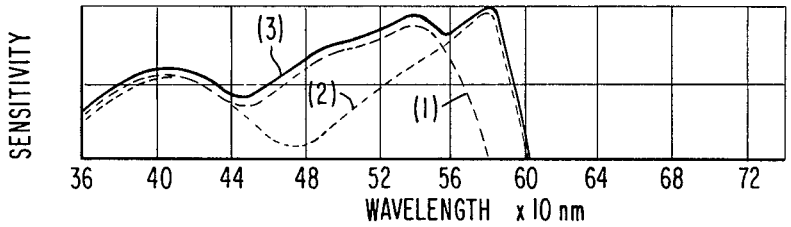
FIGS. 1 to 4 are spectral sensitivity curves obtained from the samples in Test 2 in Example 1, Test 6 in Example 1, Test 15 in Example 1 and Test 32 in Example 2, respectively.

Particularly effective cyanine dyes employed in combination with the sensitizing dyes of general formula (I) can be represented by general formula (II):

(II)

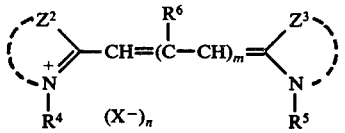

wherein $Z^2$ and $Z^3$ each represents the atoms necessary to complete an imidazole ring, an oxazole ring, a thiazole ring, a selenazole ring, a thiazoline ring, a quinoline ring or an indolenine ring; $R^4$ and $R^5$ each represents an aliphatic group (which term includes a substituted and unsubstituted aliphatic group), the carbon chain of which may be interrupted by an oxygen or sulfur atom; $R^6$ represents a hydrogen atom, an alkyl group of 1 to 8 carbon atoms, preferably 1 to 3 carbon atoms, an aralkyl group where the alkyl moiety has 1 to 5 carbon atoms, preferably 1 to 2 carbon atoms, or an aryl group; *m* represents 0 or 1; X represents an acid anion (there is no particular limitation on the acid anion selected); and *n* represents 0 or 1, *n* being 0 when the sensitizing dye is an intramolecular salt.

Particularly effective merocyanine dyes employed in combination with the sensitizing dyes of general formula (I) can be represented by general formula (III):

(III)

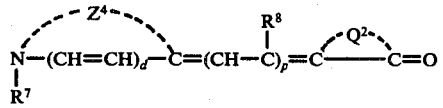

wherein $Z^4$ represents the atoms necessary to complete a 5- or 6-membered heterocyclic ring containing N, S, Se or O as a hetero atom or as hetero atoms (preferably O), preferably with 3 to 5 carbon atoms in combination with the hetero atom(s) to form the ring (the most preferred ring formed by $Z^4$ is benzoxazole); $Q^2$ represents the atoms necessary to complete a 2-thio-oxazolidine-2,4-dione ring, a rhodanine ring or a 2-thiohydantoin ring; $R^7$ represents an aliphatic group (which term includes a substituted and unsubstituted aliphatic group), the carbon ring of which may be interrupted by an oxygen or sulfur atom; $R^8$ represents a hydrogen atom, an alkyl group of 1 to 8 carbon atoms, preferably 1 to 4 carbon atoms (which term includes substituted and unsubstituted alkyl groups) or an aryl group (which term includes substituted and unsubstituted aryl group); *p* represents 0 or 1; and *d* represents 0 or 1.

In the above formulas (I), (II) and (III), each moiety is preferably defined as follows:

$Z^1$ represents the atoms necessary to complete a benzisoxazole ring. Illustrative examples thereof are benzisoxazole, 5-chlorobenzisoxazole, 4,6-dichlorobenzisoxazole, 4,6-dibromobenzisoxazole, 7-methylbenzisoxazole, 6-methylbenzisoxazole, 6,7-dimethylbenzisoxazole, 7-ethylbenzisoxazole, 7-methoxybenzisoxazole, 6-methoxybenzisoxazole, 6-hydroxybenzisoxazole, 7-phenylbenzisoxazole, 5-chloro-7-ethylbenzisoxazole and the like, where the most preferred ring is unsubstituted benzisoxazole; $R^1$ represents an alkyl group (e.g., methyl, ethyl, propyl, etc.), a sulfoalkyl group (e.g., 2-sulfoethyl, 3-sulfopropyl, 3-sulfobutyl, 4-sulfobutyl, etc.), a carboxyalkyl group (e.g., 2-carboxyethyl, 3-carboxypropyl, 4-carboxybutyl, carboxymethyl, etc.), a hydroxyalkyl group (e.g., 2-hydroxyethyl, 3-hydroxypropyl, 4-hydroxybutyl, etc.), an alkoxyalkyl group (e.g., 2-methoxyethyl, 3-methoxypropyl), etc.), an acyloxyalkyl group (e.g., 2-acetoxyethyl, etc.), an alkoxycarbonylalkyl group (e.g., methoxycarbonylmethyl, 2-methoxycarbonylethyl, 4-ethoxycarbonylbutyl, etc.), a sulfatoalkyl group (e.g., 2-sulfatoethyl, 4-sulfatobutyl, etc.), an aralkyl group (e.g., benzyl, phenethyl, p-sulfobenzyl, etc.), and an alkenyl group (e.g., vinylmethyl, etc.) with 3 to 8 carbon atoms, preferably 3 to 6 carbon atoms; $Q^1$ and $Q^2$ each represents a 2-thio-oxazolidine-2,4-dione, rhodanine or 2-thiohydantoin ring which may be substituted with groups which do not impair spectral sensitization properties such as an aralkyl group, a carboxyalkyl group, a hydroxyalkyl group, an alkoxycarbonylalkyl group, an alkoxyalkyl group, an acyloxyalkyl group where the alkyl and alkoxyl moieties each have 1 to 8 and 2 to 5 carbon atoms, respectively and an alkenyl group of 3 to 4 carbon atoms, which groups can also have the same meaning as for $R^1$, but for these substituents for $Q^1$ and $Q^2$, however, the term alkoxyalkyl includes a substituted alkoxyalkyl group (e.g., hydroxymethoxymethyl, 2-hydroxyethoxymethyl, 2-(2-hydroxyethoxy)ethyl, 2-(2-acetoxyethyl)ethyl, acetoxymethoxymethyl, etc.), a dialkylaminoalkyl group (e.g., 2-dimethylaminoethyl, 2-diethylaminoethyl, 3-dimethylaminopropyl, 2-piperidinoethyl, 2-morpholinoethyl, etc.), an N-(N,N-dialkylaminoalkyl)carbamoylalkyl group (e.g., N-[3-(N,N-dimethylamino)propyl]carbamoylmethyl, N-[2-(N,N-diethylamino)ethyl]carbamoylmethyl, N-[3-(morpholino)propyl]-carbamoylmethyl, N-[3-(piperidino)-propyl]carbamoylmethyl, etc.), an N-(N,N,N-trialkylammonioalkyl)carbamoylalkyl group (e.g., N-[3-(N,N,N-trimethylammonio)propyl]carbamoylmethyl, N-[3-(N,N,N-triethylammonio)propyl]carbamoylmethyl, N-[3-(N-methylmorpholinio)propyl]carbamoylmethyl, N-[3-(N-methylpiperidinio)propyl]carbamoylmethyl, etc.), an N,N,N-trialkylammonioalkyl group (e.g., N,N-diethyl-N-methylammonioethyl, N,N,N-triethylammonioethyl, etc.), a cyanoalkyl group (e.g., 2-cyanoethyl, 3-cyanopropyl, etc.), a carbamoylalkyl group (e.g., 2-carbamoylethyl, 3-carbamoylpropyl, etc.), an alkyl group substituted with a heterocyclic ring (e.g., tetrahydrofurfurylmethyl, furfurylmethyl, etc.), and an aryl group where this term has the same general meaning as earlier set forth (e.g., phenyl, p-chlorophenyl, p-tolyl, p-methoxyphenyl, p-carboxyphenyl, p-methoxycarbonylphenyl, m-acetylaminophenyl, p-acetylaminophenyl, m-dialkylaminophenyl (such as m-dimethylaminophenyl), p-dialkylaminophenyl (such as p-dimethylaminophenyl), and the like, which examples also apply to earlier recited ary groups).

$Z^2$ and $Z^3$ each represents an imidazole ring such as a 1-methyl-5-chlorobenzimidazole, 1-methyl-5-fluorobenzimidazole, 1-methyl-5,6-dichlorobenzimidazole, 1-methyl-5,6-difluorobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5-fluorobenzimidazole, 1-allyl-5,6-dichlorobenzimidazole, 1-allyl-5,6-difluorobenzimidazole, 1-ethyl-5-methoxycarbonylbenzimidazole, 1-ethyl-5-methylsulfonylbenzimidazole, 1-phenyl-5-chlorobenzimidazole, 1-phenyl-5-fluorobenzimidazole, 1-phenyl-5,6-dichlorobenzimidazole, 1-phenyl-5,6-difluorobenzimidazole, and 1-ethyl-5-trifluoromethylbenzimidazole; an oxazole ring such as oxazole, 4-methyloxazole, 5-methyloxazole, 4,5-dimethyloxazole, 4-p-tolyloxazole, benzoxazole, 5-fluorobenzoxazole, 5-chlorobenzoxazole, 5-bromobenzoxazole, 3-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxybenzoxazole, 5-acetylbenzoxazole, 5-hydroxybenzoxazole, and naphtho[1,2-d]oxazole; a thiazole ring such as thiazole, 4-methylthiazole, 4-phenylthiazole, 4,5-dimethylthiazole, 4-methyl-5-phenylthiazole, benzothiazole, 5-chlorobenzothiazole, 5-bromobenzothiazole, 5-methylbenzothiazole, 5-methoxybenzothiazole, 5-ethoxybenzothiazole, 6-methylbenzothiazole, 6-chlorobenzothiazole, 5-carboxybenzothiazole, 5-acetylbenzothiazole, 5-methoxycarbonylbenzothiazole, 5-hydroxybenzothiazole, 5-trifluorobenzothiazole, 5-cyanobenzothiazole, 5,6-dimethylbenzothiazole, 5-acetylaminobenzothiazole, 6-methoxybenzothiazole, 5,6-dimethoxybenzothiazole, 5,6-dichlorobenzothiazole and naphtho[1,2-d]thiazole; a selenazole ring such as selenazole, 4-methylselenazole, 4-phenylselenazole, 4,5-dimethylselenazole, benzoselenazole, 5-chlorobenzoselenazole, 5-bromobenzoselenazole, 5-methylbenzoselenazole, 5-methoxybenzoselenazole, 5,6-dimethylbenzoselenazole and naphtho[1,2-d]selenazole; a thiazoline ring such as thiazoline, 4,4-dimethylthiazoline, 4,5-dimethylthiazoline, etc.; a quinoline ring such as quinoline, 6-methylquinoline, 6-ethylquinoline, 6-methoxyquinoline, 6-ethoxyquinoline, 6-hydroxyquinoline and 6-bromoquinoline; and a 3,3-dialkylindolinine ring such as 3,3-dimethylindolinine, etc.; $Z^4$ represents the same oxazole, thiazole, selenazole, thiazoline, imidazole, 2-quinoline or 4-quinoline ring as defined for $Z^2$ and $Z^3$, and, in addition, a pyridine ring, a pyrroline ring such as 3-ethylpyrroline, 5-ethylpyrroline, 5-phenylpyrroline, etc., and a tetrazole ring such as 1,3-dimethyltetrazole, 1,3-diphenyltetrazole, etc.; $R^4$, $R^5$ and $R^7$ represents the same alkyl, carboxyalkyl, hydroxyalkyl and sulfoalkyl (including, in addition, 2-(3-sulfopropoxy)ethyl, 2-hydroxy-3-sulfopropyl, 3-sulfopropoxyethoxyethyl, and the like) group as defined for $R^1$, a vinylmethyl group, and the like; $R^6$ represents a hydrogen atom, an alkyl group such as methyl, ethyl, propyl, etc., an aryl or aralkyl group such as a phenyl group, a benzyl group, a phenethyl group, and the like; $R^8$ represents a hydrogen atom, a methyl group, an ethyl group, a propyl group, a substituted alkyl group such as a hydroxy, carboxy, alkoxy (e.g., methoxy, ethoxy), aryloxy (e.g., phenoxy), or aryl-(e.g., phenyl), etc., substituted alkyl group (e.g., hydroxymethyl, ethoxymethyl, phenoxymethyl, 2-carboxyethyl, etc.), a phenyl group, a substituted phenyl group such as a hydroxy, carboxy, alkoxy (e.g., methoxy, ethoxy), aryloxy (e.g., phenoxy), aryl (e.g., phenyl), etc., substituted phenyl group (e.g., o-carboxyphenyl, hydroxyphenyl, ethoxyphenyl, phenoxyphenyl, etc.), a carboxyalkyl group and a hydroxyalkyl group both of the same meanings as for $R^1$ and; and X represents an acid anion used in forming conventional cyanine dye salts, such as an iodine ion, a bromine ion, a chlorine ion, a p-toluene sulfonic acid ion, a benzene sulfonic acid ion, a perchlorate ion, a thiocyanic acid ion, and the like.

Among the compounds represented by general formula (I), those represented by general formula (I-1) can be employed to advantage.

(I-1)

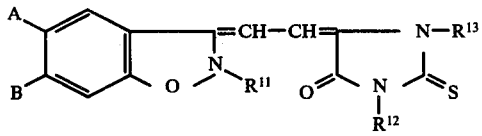

wherein $R^{11}$ and $R^{12}$ have the same meanings as $R^1$ in general formula (I) above; $R^{13}$ represents an alkyl group of 1 to 8 carbon atoms, preferably 1 to 4 carbon atoms (which may be substituted), an aryl group (which may be substituted), or an alkenyl group of 2 to 8 carbon atoms, preferably 2 to 6 carbon atoms; and A and B each represents a hydrogen atom, a halogen atom, an alkyl group of 1 to 6 carbon atoms, preferably 1 to 3 carbon atoms, an aryl group, an alkoxyl group of 1 to 6 carbon atoms, preferably 1 to 4 carbon atoms, or a hydroxyl group.

As preferred moieties represented by $R^{11}$ there are hydroxyalkyl groups, carboxyalkyl groups and sulfoalkyl groups, particularly those having up to 4 carbon atoms.

As preferred moieties represented by $R^{13}$ there are alkyl groups, hydroxyalkyl groups, carboxyalkyl groups, sulfoalkyl groups, alkoxyalkyl groups (which term includes substituted alkoxyalkyl groups, e.g., hydroxy or acetoxy substituted) and alkoxycarbonylalkyl groups. Particularly preferred substituents are alkyl groups having up to 3 carbon atoms (e.g., methyl and ethyl), hydroxyalkyl groups having up to 4 carbon atoms, sulfoalkyl groups where the alkyl moiety has 1 to 8 carbon atoms, preferably 1 to 4 carbon atoms, carboxyalkyl groups where the alkyl moiety has 1 to 8 carbon atoms, preferably 1 to 8 carbon atoms, alkoxyalkyl groups having up to 8 carbon atoms, hydroxyl-substituted alkoxyalkyl groups where alkyl and alkoxy moieties have 1 to 8 carbon atoms, preferably 1 to 4 carbon atoms, and alkoxycarbonylalkyl groups where the alkyl and alkoxy moieties have 1 to 8 carbon atoms, preferably 1 to 4 carbon atoms.

As preferred moieties represented by $R^{12}$ there are methyl, ethyl, n- or iso-propyl, phenyl and vinylmethyl groups.

Among the compounds represented by general formula (II), those represented by general formulae (II-1) and (II-2) can be used to advantage.

(II-1)

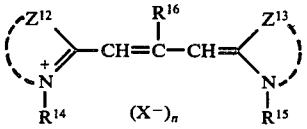

wherein $Z^{12}$ and $Z^{13}$ each represents the atoms necessary to complete a benzimidazole ring, a benzoxazole ring, a naphtho[1,2-d]oxazole ring, a benzothiazole ring, a naphtho[1,2-d]-thiazole ring, a benzoselenazole ring or a naphtho[1,2-d]-selenazole ring; $R^{16}$ represents a hydrogen atom, a methyl group, an ethyl group, a propyl group, a phenyl group, a benzyl group or a phenethyl group; and $R^{14}$, $R^{15}$, X and n have the same meanings as $R^4$, $R^5$, X and n in general formula (II), respectively.

Among the compounds represented by general formula (II-1), those in which at least one of the rings completed by $Z^{12}$ and $Z^{13}$ is a benzimidazole ring and $R^{14}$ and $R^{15}$ are alkyl groups (the carbon chain of which may be interrupted by an oxygen or sulfur atom) of 1 to 6 carbon atoms, preferably 1 to 4 carbon atoms, hydroxyalkyl groups or carboxyalkyl groups where the alkyl moiety has 1 to 6 carbon atoms, preferably 1 to 4 carbon atoms, or sulfoalkyl groups where the alkyl moiety has 1 to 8 carbon atoms, preferably 1 to 4 carbon atoms, are preferred.

Among the compounds represented by general formula (II-1), another preferred group of compounds includes those in which each of the rings completed by $Z^{12}$ and $Z^{13}$ is a benzoxazole ring, a naphtho[1,2-d]oxazole ring, a benzothiazole ring, a naphtho[1,2-d]thiazole ring, a benzoselenazole ring or a naphtho[1,2-d]selenazole ring, and $R^{14}$ and $R^{15}$ have the same meanings as $R^2$ and $R^3$ in general formula (II), at least one of $R^{14}$ and $R^{15}$ being a hydroxyalkyl group where the alkyl moiety has 1 to 8 carbon atoms, preferably 2 to 5 carbon atoms, a carboxyalkyl group where the alkyl moiety has 1 to 6 carbon atoms, preferably 1 to 4 carbon atoms or a sulfoalkyl group where the alkyl moiety has 1 to 8 carbon atoms, preferably 1 to 4 carbon atoms.

(II-2)

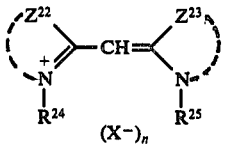

wherein $Z^{22}$ and $Z^{23}$ each represents the atoms necessary to complete a benzimidazole ring, a benzoxazole ring, a naphtho[1,2-d]oxazole ring, a benzothiazole ring, a naphtho[1,2-d]thiazole ring, a benzoselenazole ring, a naphtho[1,2-d]selenazole ring or a quinoline ring; and $R^{24}$, $R^{25}$, X and n have the same meanings as $R^4$, $R^5$, X and n in the above general formula (II), respectively.

Among the compounds represented by general formula (II-2), those in which each of the rings completed by $Z^{22}$ and $Z^{23}$ is a benzoxazole ring, a naphtho[1,2-d]oxazole ring, a benzothiazole ring, a naphtho[1,2-d]thiazole ring, a benzoselenazole ring or a naphtho[1,2-d]selenazole ring, and at least one of $R^{24}$ and $R^{25}$ is a hydroxyalkyl group where the alkyl moiety has 1 to 8 carbon atoms, preferably 2 to 5 carbon atoms, a carboxyalkyl group where the alkyl moiety has 1 to 6 carbon atoms, preferably 1 to 4 carbon atoms or a sulfoalkyl group where the alkyl moiety has 1 to 8 carbon atoms, preferably 1 to 4 carbon atoms, are preferred.

Among the compounds represented by general formula (II-1), those represented by general formula (II-01) and (II-02) are particularly preferred.

(II-01)

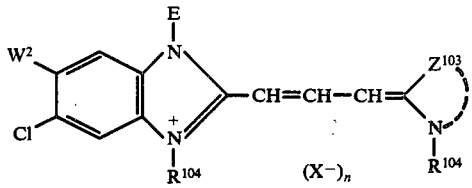

wherein $W^2$ represents a hydrogen atom or a chlorine atom; E represents a methyl group, an ethyl group or a propyl group; $R^{104}$ represents an alkyl group containing up to 3 carbon atoms, a sulfoalkyl group containing up to 4 carbon atoms, a carboxyalkyl group where the alkyl moiety has 1 to 6 carbon atoms, preferably 1 to 4 carbon atoms, or a hydroxyalkyl group where the alkyl moiety has 1 to 8 carbon atoms, preferably 2 to 5 carbon atoms; $Z^{103}$ represents the atoms necessary to complete a benzimidazole ring, a benzoxazole ring, a naphtho[1,2-d]-oxazole ring, a benzothiazole ring, a naphtho[1,2-d]thiazole ring or a benzoselenazole ring; and X and n are as defined in general formula (II).

(II-02)

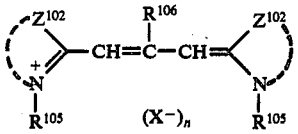

wherein $Z^{102}$ represents the atoms necessary to complete a benzoxazole ring, a naphtho[1,2-d]oxazole ring, a benzothiazole ring, a naphtho[1,2-d]thiazole ring, a benzoselenazole ring or a naphtho[1,2-d]selenazole ring; $R^{105}$ represents a sulfoalkyl group containing up to 4 carbon atoms, a carboxyalkyl group where the alkyl moiety has 1 to 6 carbon atoms, preferably 1 to 4 carbon atoms, or a hydroxyalkyl group where the alkyl moiety has 1 to 8 carbon atoms, preferably 2 to 5 carbon atoms; $R^{106}$ represents a methyl group, an ethyl group, a propyl group or a phenyl group; and X and *n* are as defined in general formula (II).

Among the compounds represented by general formula (III), those represented by general formulae (III-1) or (III-2) can be used to advantage.

(III-1)

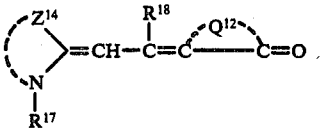

wherein $Z^{14}$ represents the atoms necessary to complete a benzoxazole ring, a benzothiazole ring, a benzoselenazole ring, a thiazoline ring, a benzimidazole ring, a pyrroline ring or a tetrazole ring; and $R^{17}$, $R^{18}$ and $Q^{12}$ have the same meanings as $R^7$, $R^8$ and $Q^2$ in general formula (III), respectively.

(III-2)

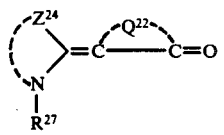

wherein $Z^{24}$ represents the atoms necessary to complete a benzoxazole ring, a naphtho[1,2-d]oxazole ring, a benzothiazole ring, a naphtho[1,2-d]thiazole ring, a benzoselenazole ring, a naphtho[1,2-d]selenazole ring, a quinoline ring or a pyridine ring; and $R^{27}$ and $Q^{22}$ have the same meanings as $R^7$ and $Q^2$ in general formula (III), respectively.

Among the compounds represented by general formula (III-1), these represented by general formula (III-3) are preferred.

(III-3)

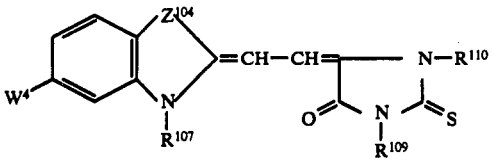

wherein $Z^{104}$ represents an oxygen atom, a sulfur atom or a selenium atom; $W^4$ represents a hydrogen atom, a halogen atom (e.g., chlorine and bromine), an alkyl group of 1 to 6 carbon atoms, preferably 1 to 4 carbon atoms (e.g., methyl and ethyl), alkoxyl group where the alkyl moiety has 1 to 6 carbon atoms, preferably 1 to 4 carbon atoms (e.g., methoxy and ethoxy), or a hydroxyl group; $R^{107}$ represents an alkyl group of 1 to 6 carbon atoms, preferably 1 to 4 carbon atoms, a hydroxyalkyl group where the alkyl moiety has 1 to 8 carbon atoms, preferably 1 to 4 carbon atoms, a carboxyalkyl group where the alkyl moiety has 1 to 6 carbon atoms, preferably 1 to 4 carbon atoms, or a sulfoalkyl group where the alkyl moiety has 1 to 8 carbon atoms, preferably 1 to 4 carbon atoms; $R^{109}$ represents an alkyl group of 1 to 6 carbon atoms, preferably 1 to 4 carbon atoms, an aryl group or an alkenyl group of 2 to 8 carbon atoms, preferably 2 to 6 carbon atoms; and $R^{110}$ represents an alkyl group of 1 to 6 carbon atoms, preferably 1 to 4 carbon atoms, a hydroxyalkyl group where the alkyl moiety has 1 to 8 carbon atoms, preferably 1 to 4 carbon atoms, a carboxyalkyl group where the alkyl moiety has 1 to 6 carbon atoms, preferably 1 to 4 carbon atoms, a sulfoalkyl group where the alkyl moiety has 1 to 8 carbon atoms, preferably 1 to 4 carbon atoms, an alkoxyalkyl group where the alkyl and alkoxyl moieties each have 1 to 8 carbon atoms, preferably 1 to 4 carbon atoms (which term includes a substituted alkoxyalkyl group where the alkyl and alkoxyl moieties each have 1 to 8 carbon atoms, preferably 1 to 4 carbon atoms (e.g., hydroxy or acetoxy substituted) or an alkoxycarbonylalkyl group where the alkyl and alkoxyl moieties each have 1 to 8 carbon atoms, preferably 1 to 4 carbon atoms.

Particularly preferred compounds included in general formula (III-1) are those in which $Z^{104}$ is an oxygen atom; $W^4$ is a hydrogen atom, a chlorine atom, a methyl group or a methoxy group; $R^{107}$ is a hydroxyalkyl group containing up to 4 carbon atoms, a carboxyalkyl group where the alkyl moiety has 1 to 6 carbon atoms, preferably 1 to 4 carbon atoms, or a sulfoalkyl group where the alkyl moiety has 1 to 8 carbon atoms, preferably 1 to 4 carbon atoms; $R^{109}$ is a methyl group, an ethyl group, a propyl group, a phenyl group or a vinylmethyl group; and $R^{110}$ is a methyl group, an ethyl group, a propyl group, a hydroxyalkyl group containing up to 4 carbon atoms, a carboxyalkyl group where the alkyl moiety has 1 to 6 carbon atoms, preferably 1 to 4 carbon atoms, a sulfoalkyl group where the alkyl moiety has 1 to 8 carbon atoms, preferably 1 to 4 carbon atoms or an alkoxyalkyl group where the alkyl and alkoxyl moieties have 1 to 8 carbon atoms, preferably 1 to 4 carbon atoms substituted with a hydroxyalkyl group containing up to 4 carbon atoms.

Among the compounds represented by general formula (III-2), those represented by general formula (III-4) are most preferred.

(III-4)

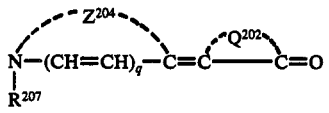

wherein $Z^{204}$ represents the atoms necessary to complete a benzoxazole ring, a naphtho[1,2-d]oxazole ring, a benzothiazole ring, a naphtho[1,2-d]thiazole ring, a benzoselenazole ring, a naphtho[1,2-d]selenazole ring or a pyridine ring; $q$ represents 0 or 1; $Q^{202}$ represents the atoms necessary to complete a 2-thiohydantoin ring or a rhodanine ring; and $R^{207}$ represents an alkyl group containing up to 4 carbon atoms, a hydroxyalkyl group where the alkyl moiety has 1 to 8 carbon atoms, preferably 1 to 4 carbon atoms, a carboxyalkyl group where the alkyl moiety has 1 to 6 carbon atoms, preferably 1 to 4 carbon atoms, or a sulfoalkyl group where the alkyl moiety has 1 to 8 carbon atoms, preferably 1 to 4 carbon atoms.

In the above discussion, any aryl moiety includes both unsubstituted and substituted monoaryl as the typical examples thereof. A preferred example of a monoaryl group is phenyl, and substituents on the monoaryl group include an alkyl ($C_1 - C_8$, preferably $C_1 - C_4$), an alkoxy ($C_1 - C_8$, preferably $C_1 - C_4$), a halogen (Cl, Br), a carboxyl, etc., group.

Examples of the sensitizing dyes used in the invention are given below, but it should be understood that the dyes of this invention are not to be limited to those set out.

Sensitizing dyes represented by general formula (I):

(I-1)

-continued
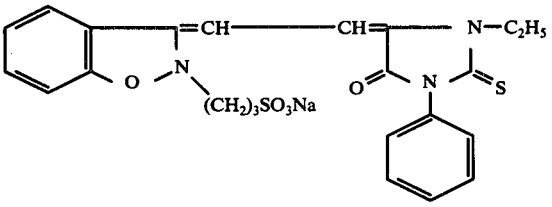
(I-2)
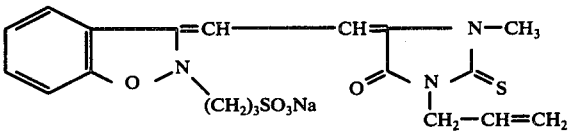
(I-3)
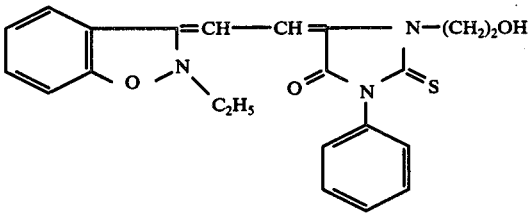
(I-4)
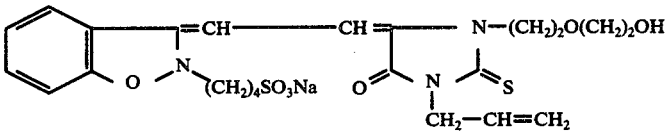
(I-5)
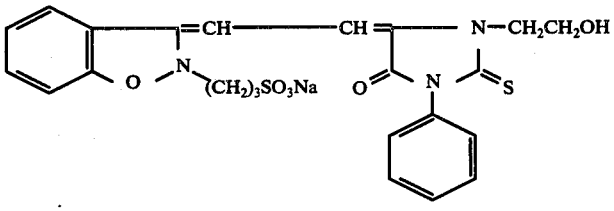
(I-6)
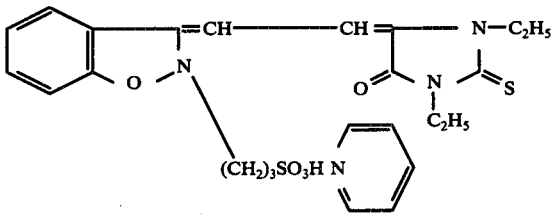
(I-7)
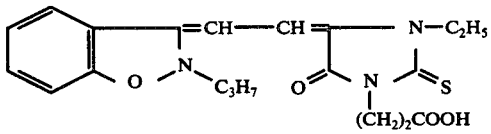
(I-8)
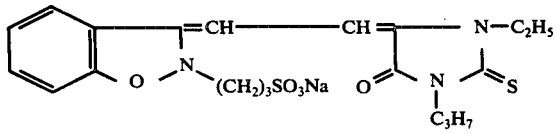
(I-9)

-continued
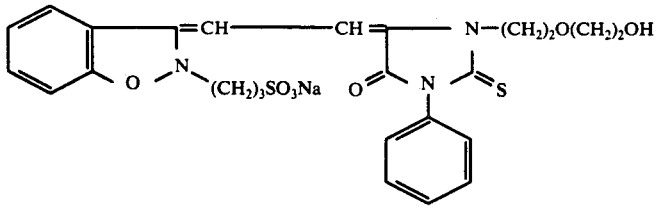
(I-10)
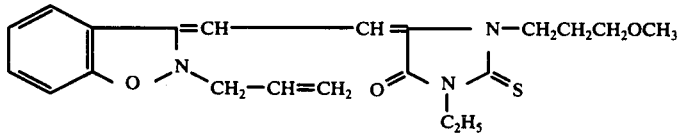
(I-11)
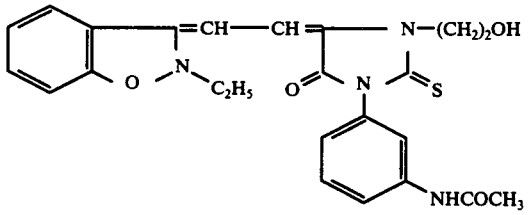
(I-12)
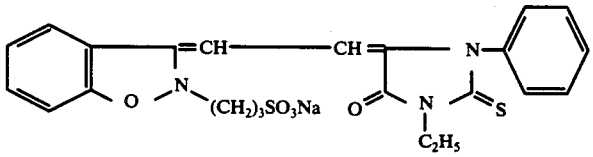
(I-13)
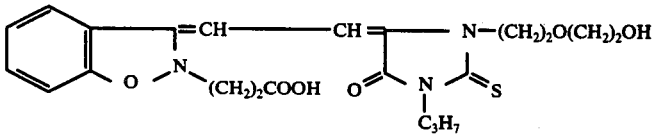
(I-14)
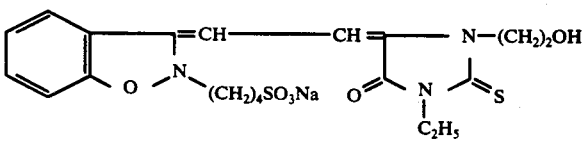
(I-15)
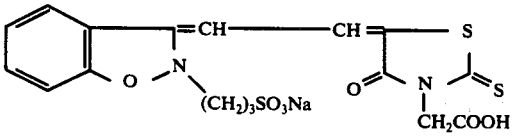
(I-16)
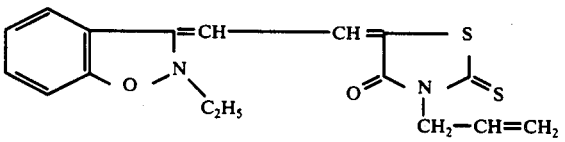
(I-17)
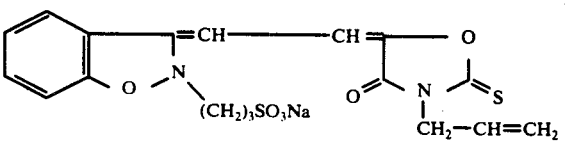

Sensitizing dyes represented by general formula (II):
(II-1)
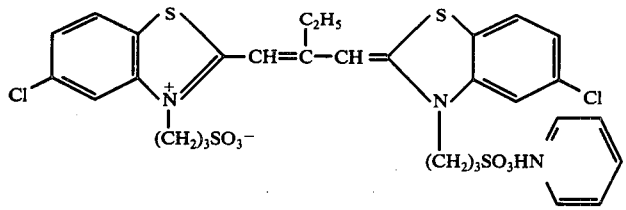
(II-2)
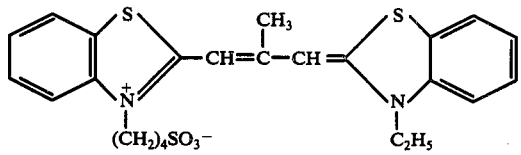
(II-3)
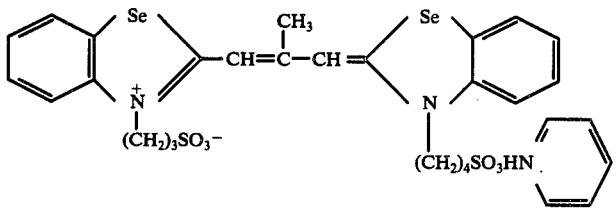
(II-4)
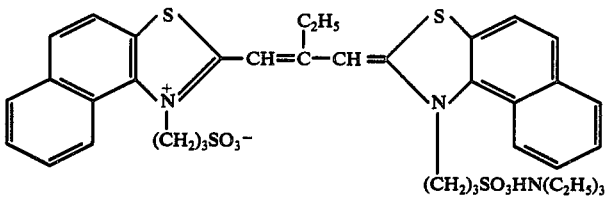
(II-5)
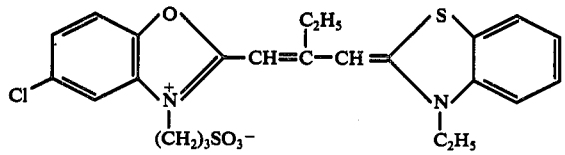
(II-6)
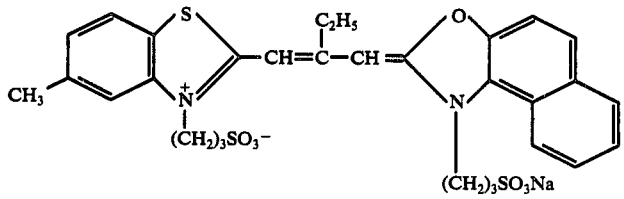
(II-7)
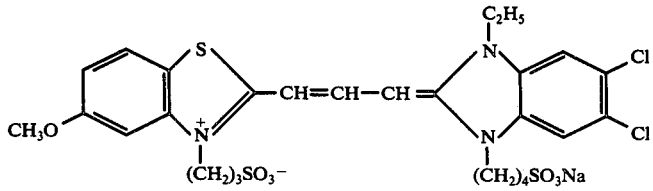
(II-8)

-continued
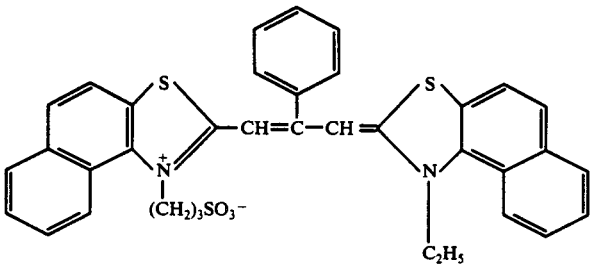
(II-9)
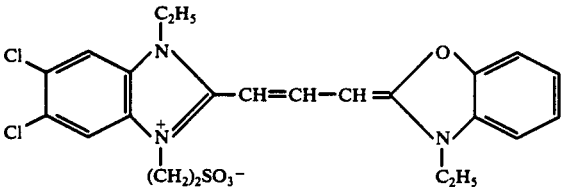
(II-10)
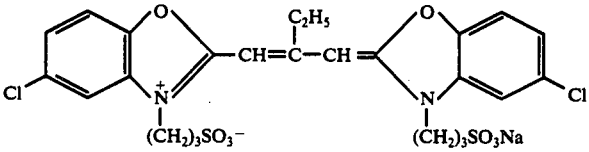
(II-11)
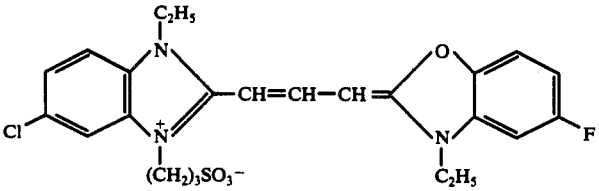
(II-12)
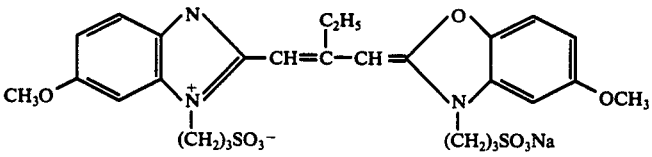
(II-13)
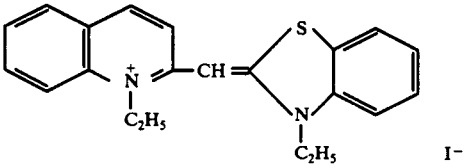
(II-14)
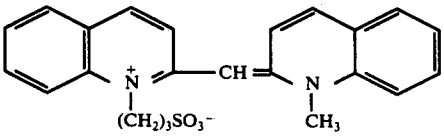
(II-15)
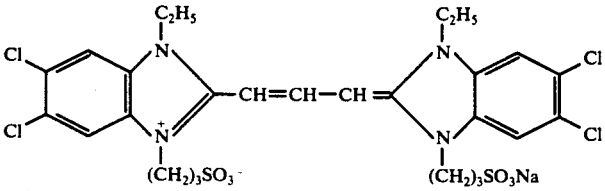
(II-16)

-continued
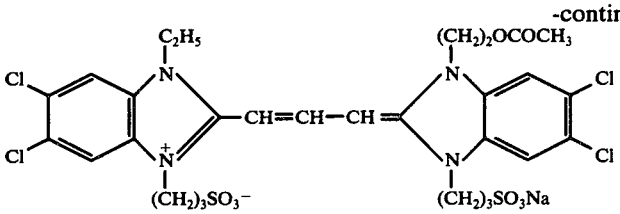
(II-17)
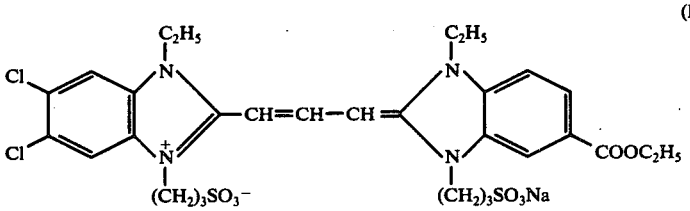
(II-18)
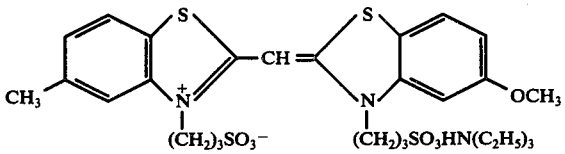
(II-19)
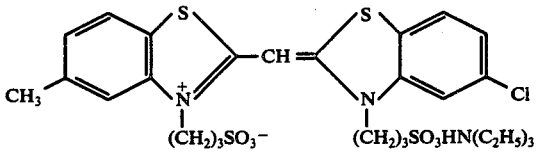
(II-20)
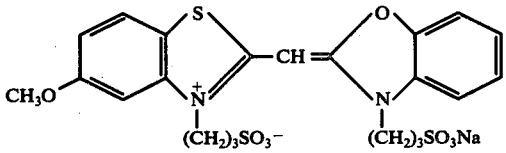
(II-21)
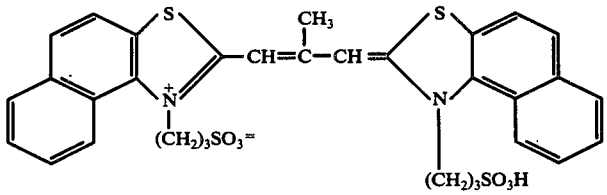
(II-22)
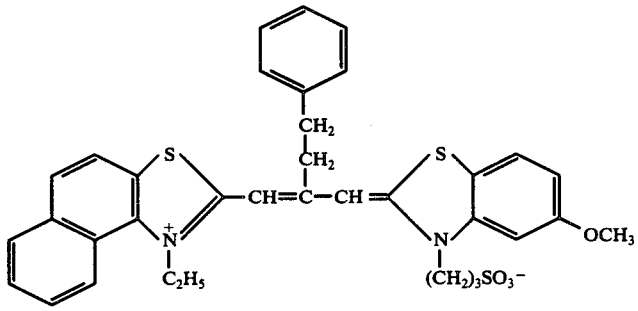
Sensitizing dyes represented by general formula (III):
(III-1)

-continued
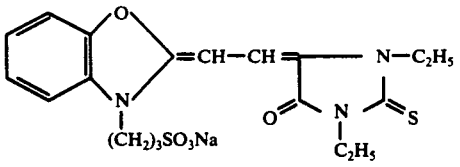
(III-2)
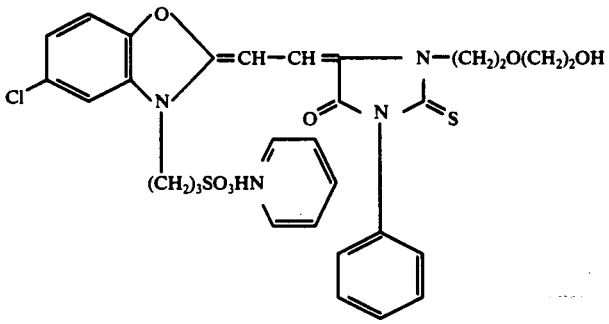
(III-3)
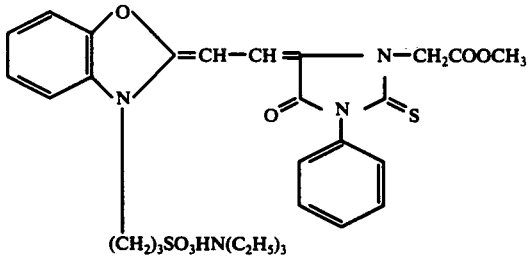
(III-4)
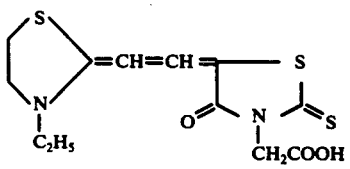
(III-5)
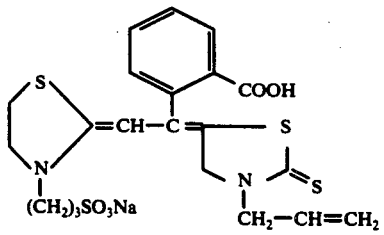
(III-6)
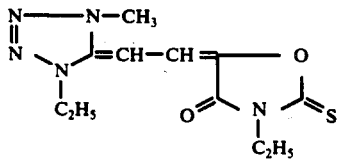
(III-7)
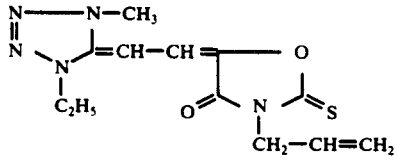

-continued
(III-8)
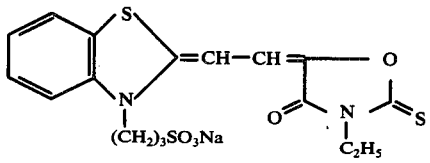
(III-9)
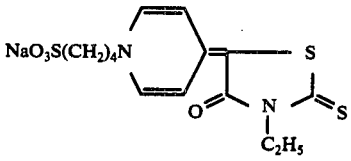
(III-10)
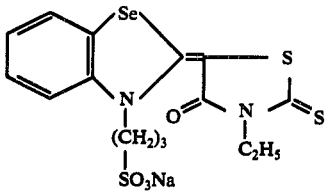
(III-11)
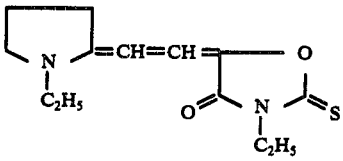
(III-12)
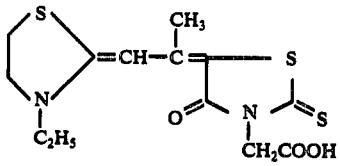
(III-13)
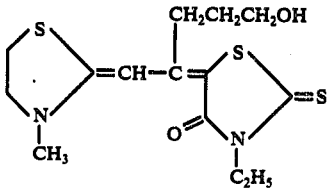
(III-14)
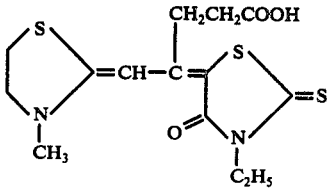
-continued
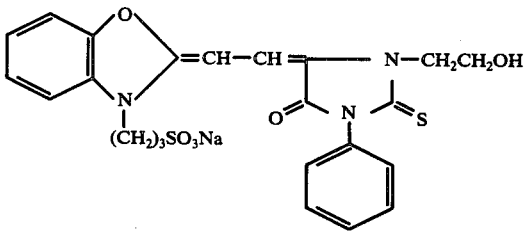
The structural formulas of the dyes used for the purpose of comparison were as follows:
(A)

-continued (B)

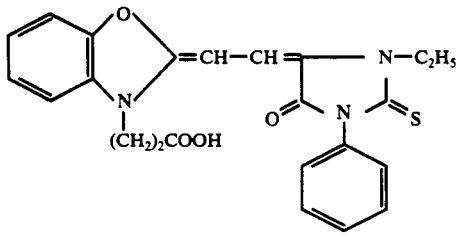

(C)

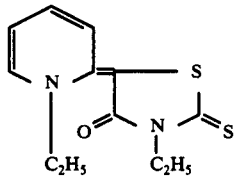

In this invention, it is of importance that a benzisoxazole ring is present in the dyes represented by general formula (I). Among the dyes represented by general formula (I), those further containing a 2-thiohydantoin ring, particularly those containing a 2-thiohydantoin ring substituted with an aliphatic group such as an alkyl or alkenyl group, preferably having from 1 to 4 carbon atoms, can be employed to further advantage. In addition, when a dye in which the nitrogen atom of the benzisoxazole ring is substituted with a sulfoalkyl group, preferably having from 1 to 4 carbon atoms, is employed, more preferred effects are obtained in accordance with the invention.

Although some of the dyes of general formula (I) are disclosed in U.S. Pat. No. 3,071,467, the present invention is clearly distinguished from this patent since it is not concerned with supersensitization.

The optimum concentration of the sensitizing dyes used in the invention can be determined by dividing an emulsion into several parts, incorporating in each of them varying amounts of sensitizing dyes and measuring the sensitivity thereof, according to methods known by those skilled in the art.

The merocyanine dyes represented by general formula (I) and the cyanine dyes represented by general formula (II) or the merocyanine dyes represented by general formula (III) may each be incorporated in silver halide photographic emulsions in an amount of from $1 \times 10^{-6}$ to $5 \times 10^{-3}$, preferably from $1 \times 10^{-5}$ to $2.5 \times 10^{-3}$, particularly preferably from $8 \times 10^{-5}$ to $1 \times 10^{-3}$, mol per mol of silver halide(s), and the molar ratio of the dyes represented by general formula (I) to the other dyes is preferably from 1:10 to 10:1.

The sensitizing dyes used in this invention can be added to silver halide photographic emulsions in the form of a solution in water or an organic solvent miscible with water, such as methanol, ethanol, methyl cellosolve, dimethylformamide and pyridine. The sensitizing dyes used in the invention can be dissolved in a solvent by applying ultrasonic vibrations as described in U.S. Pat. No. 3,485,634. The sensitizing dyes of the invention may also be incorporated into emulsions in the form of a solution or a dispersion in accordance with the procedures as described in U.S. Pat. Nos. 3,482,981, 3,585,195, 3,469,987, 3,425,835, 3,342,605, 3,660,101, and 3,658,546, and British Patents 1,271,329, 1,038,029, and 1,121,174, as well as Offenlegungschrift 2,104,283 and U.S. Pat. No. 3,649,286.

Combinations of dyes consisting of one or more dyes of general formula (I), one or more dyes of general formula (II) and one or more dyes of general formula (III) can also be used.

In addition to the combinations of sensitizing dyes of the invention, i.e., a combination of one or more dyes of general formula (I) and one or more dyes of general formula (II), or a combination of one or more dyes of general formula (I) and one or more dyes of general formula (III), known dyes can also be employed in combination therewith.

The silver halide photographic emulsions used in this invention can be prepared by conventional methods such as the ammoniacal, neutral and acid techniques as described by Mees, *The Theory of Photographic Process,* Macmillan; and by Glafkides, *Photographic Chemistry,* Fountain Press. The silver halide photographic emulsions used in this invention can comprise silver chloride, silver bromide, silver iodide or mixed silver halide grains which are precipitated by a single jet technique, double jet technique or a combined technique thereof, and then physically ripened. Suitable silver halides include silver chlorobromide, silver bromide, silver chloroiodide, silver bromoiodide, and silver chloroiodobromide (preferably having a silver iodide content less than 10% by weight). The silver halide emulsions can be either coarse or fine grained, but fine grained emulsions having an average grain size of 0.04 $\mu$ to 2 $\mu$ (arithmetical mean value determined, for example, by the projected area method) are preferred.

The crystal structure of the silver halide grains used in the invention can be uniform or layered where the core is different in quality from the shell, or the so-called conversion type grains as described in British Patent 635,841 and U.S. Pat. No. 3,622,318. Moreover, the silver halide grains can be either of the type which form latent images predominantly on the surface of the grain or of the type which form latent images predominantly in the interior of the grain.

In this invention, there is advantageously employed silver halide emulsions containing more than 50 mol% silver chloride (which may contain less than 45 mol% silver bromide and less than 5 mol% silver iodide), particularly those containing more than 70 mol% silver chloride. Such silver halide emulsions and related techniques are described, for example, in U.S. Pat. Nos. 2,400,532, 3,142,568, 3,288,612, 3,294,540, 3,345,175, 3,516,830 and 3,625,689 (these photographic emulsions and photographic light-sensitive materials are processed according to the methods described in U.S. Pat. Nos. 3,294,540, 3,516,830, 3,537,914, 3,600,174, 3,615,174, 3,615,524, 3,625,689, etc.).

After precipitation or physical ripening, soluble salts are ordinarily removed from the silver halide emulsions. As the means for removing soluble salts, there can be employed either the noodle washing technique, which has long been known, or the flocculation technique using inorganic salts containing polyvalent anions (e.g., ammonium sulfate), anionic surface active agents, polystyrene sulfonic acids, other anionic polymers, or gelatin derivatives such as aliphatic or aromatic acylated gelatins.

The silver halide emulsions used in the invention may be or may not be chemically sensitized. They can be chemically sensitized by the methods described in the above texts by Mees, Glafkides or in H. Frieser, Ed., *Die Grusendlagen der Photographischen Prozesse mit Silberhalogeniden,* Akademische Verlagsgellschaft (1968), as well as other known methods, including sulfur sensitization using compounds containing sulfur atoms capable of reacting with silver ions, such as thiosulfates, active gelatins or those compounds described in U.S. Pat. Nos. 1,574,944, 2,278,947, 2,410,689, 3,189,458 and 3,501,313 and French Patent 2,059,245; reduction sensitization using, for example, stannous salts such as those described in U.S. Pat. No. 2,487,850; amines such as those described in U.S. Pat. Nos. 2,518,698, 2,521,925, 2,521,926, 2,419,973 and 2,419,975; iminoaminomethane sulfinic acids such as those described in U.S. Pat. No. 2,983,610; or silane compounds such as those described in U.S. Pat. No. 2,694,637; or employing the methods described by H. W. Wood, *Journal of Photographic Science,* Vol. 1 (1953), p. 163; gold sensitization using gold complexes such as those described in U.S. Pat. No. 2,399,083 or thiosulfate complexes; or sensitization using salts of noble metals such as platinum, palladium, iridium, rhodium or ruthenium such as those described in U.S. Pat. Nos. 2,448,060, 2,540,086, 2,566,245 and 2,566,263. Combinations of these methods can also be used. The selenium sensitization method described in U.S. Pat. No. 3,297,446 can be used in place of the sulfur sensitization method, if desired.

The photographic emulsions of the invention can contain various compounds in order to prevent fogging or to stabilize photographic properties during production, storage or processing. Examples of useful antifoggants or stabilizers include azoles, nitroazoles, halogen-substituted azoles, mercapto compounds such as mercaptoazoles, mercaptopyrimidines, mercaptotriazines, mercaptotetrazaindenes, thiosalicylic acid, etc., tetrazaindenes, pentazaindenes, benzene sulfinic acids, benzene sulfonic acids, and the like.

In order to enhance sensitivity, to improve contrast or to accelerate development, the photographic emulsions of this invention can comprise compounds such as alkylene oxide derivatives, thioether compounds, thiomorpholines, quaternary ammonium salts, pyrrolidines, urethane derivatives, urea derivatives, imidazole derivatives, 3-pyrazolidones, and the like.

The photographic emulsions of the invention have added thereto organic or inorganic mercury compounds for the purpose of sensitization or fog prevention.

The photographic emulsions of the invention can contain various addenda having various functions of improving the quality of photographic light-sensitive materials, such as hardeners, coating aids, plasticizers, emulsion polymerization latexes, antistatic agents, UV absorbers, dyes, antioxidants, and the like.

In the photographic emulsions of the invention there may be used organic hardeners, such as aldehyde compounds, acetone compounds, ketone compounds, active halogen-containing compounds, active olefin-containing compounds, N-methylol compounds, carboiimides, epoxy compounds, isoxazole compounds, dioxane derivatives, mucohalogenoic acids, etc., high molecular weight hardeners and inorganic hardeners such as complex salts of chromium, zirconium salts, etc.

The photographic emulsions of the invention have added thereto various known surface active agents for the purpose of preventing static charges or adhesion, improving slippage capability of dispersing capability, sensitization, and the like. Examples of useful surface active agents used in the invention include nonionic surfactants, anionic surfactants and amphoteric surfactants.

The photographic emulsions of the invention can contain dispersions of water-soluble or water-insoluble synthetic polymers in order to improve dimensional stability and the like.

The photographic emulsions used in the invention can contain any conventional protective colloid such as gelatin, as well as acylated gelatin such as phthalated gelatin and malonated gelatin, cellulose compounds such as hydroxyethyl cellulose and carboxymethyl cellulose, soluble starches such as dextran, and hydrophilic polymers such as polyvinyl alcohol, polyvinyl pyrrolidone, polyacrylamide and polystyrene sulfonic acid alone or as compatible mixtures thereof.

The photographic emulsions of the invention can further contain conventionally used non-diffusible color image-forming couplers. By a color image-forming coupler (which will hereinafter be referred to as a coupler) is meant a compound which, upon photographic development, reacts with the oxidation product of an aromatic primary amine developer to form a dye. The coupler may be either a 2-equivalent or 4-equivalent coupler, or may be a colored coupler for color correction or a development inhibitor-releasing coupler. Useful yellow color-forming couplers include open chain ketomethylene compounds such as acylaminoacetamides; useful magenta color-forming couplers include the pyrazolone and cyanoacetyl compounds; and useful cyan color-forming couplers include the naphthols and phenols. The couplers can be incorporated into a photographic emulsion layer by using any method as is conventionally employed for multicolor light-sensitive materials.

The present invention can be applied to multilayer multicolor photographic materials having on a support at least two photosensitive layers having different spectral sensitivities. A multilayered natural color photographic material usually has, on a support, at least one red-sensitive emulsion layer, at least one green-sensitive emulsion layer, and at least one blue-sensitive emulsion layer. The order of the layers can be arbitrarily varied as desired. In ordinary combinations, a red-sensitive emulsion layer contains a cyan color-forming coupler, a green-sensitive emulsion layer contains a magenta color-forming coupler, and a blue-sensitive emulsion layer contains a yellow color-forming coupler. If desired, other combinations can be employed.

The photographic emulsions of the invention can contain, singly or as combinations thereof, developers such as aromatic diols (e.g., hydroquinones), aminophenols, phenylene diamines, 3-pyrazolidones, and the like. In the case of a water-insoluble developer, it can be added to the emulsion in the form of a dispersion.

The photographic emulsions of the invention can be coated, alone or in combination with hydrophilic colloid layers, on a support by known coating techniques, including dip coating, air knife coating, roller coating or extrusion coating. The method described in U.S. Pat. No. 2,681,294 is one advantageous method. Two or more layers can be simultaneously coated by the methods described in U.S. Pat. Nos. 2,761,791 and 3,526,528.

The photographic emulsions of the invention can be coated on either transparent or translucent supports as are conventionally employed for photographic materials, including a glass plate; films made of synthetic polymers such as polyalkylene acrylates, polyalkylene methacrylates, polystyrene, polyvinyl chloride, partially formulated polyvinyl alcohol, polyesters such as polycarbonates or polyethylene terephthalate, or polyamides; films made of cellulose derivatives such as cellulose nitrate, cellulose acetate or cellulose acetate butyrate; paper; baryta-coated paper; paper coated with α-olefins and the like; synthetic papers made of styrene; earthenware; metal; and the like.

The light-sensitive materials in which the photographic emulsions of the invention are employed can simultaneously contain other spectrally sensitized emulsion layers and/or non-spectrally sensitized emulsion layers. Their location and their relationship can be arbitrarily varied as desired.

The photographic emulsions of the invention can be processed by any conventional photographic processing method. Any conventional processing solution can be used. The processing can be carried out at a temperature below 18° C, from 18° C to 50° C, or above 50° C.

The light-sensitive materials of this invention can be processed by both processes for forming a silver image (black-and-white photographic processing) and for forming a color image (color photographic processing), depending on the end use of the element.

The photographic light-sensitive materials of the invention can be processed according to a so-called lith type processing. By a lith type processing is meant a processing where an infectious developing is conducted, usually with a developer of the dihydroxybenzene series at a low sulfite ion concentration for the purpose of photographic reproduction of line images or photographic reproduction of halftone images by means of halftone dots (further details are described, for example, in Mason, *Photographic Processing Chemistry,* pp. 163 - 165 (1966)). The emulsions of the invention are particularly effective in such lith type processings.

In a special form of processing, the photographic light-sensitive materials of the invention can contain developing agents in one or more layers, for example, in one or more emulsion layers, and can be processed in an aqueous alkaline solution. In most cases, such a processing is employed in a rapid processing system for light-sensitive materials in combination with a silver salt stabilizing processing using a thiocyanate. The light-sensitive materials of the invention can be processed according to such a system.

The silver halide photographic emulsions of the invention yield color images upon color processing. Color processing essentially comprises color developing, bleaching and fixing. Two or more of these steps can be carried out in one step by using a solution which has two or more functions (for example, a blix solution). The processing should be effected at a temperature range suited to the particular light-sensitive material processed. The processings may be carried out at a temperature below 18° C, but in most cases they are carried out at a temperature above 18° C, particularly from 20° C to 60° C. In recent years, processings are often carried out at a temperature of from 30° C to 60° C.

A color developing solution is an aqueous alkaline solution containing a color developer and having a pH value of above 8, preferably from 9 to 12. A color developer is a compound having primary amino groups on an aromatic ring which is capable of developing exposed silver halide to form its oxidation product which is, in turn, capable of forming a colored product upon reaction with a coupler, or a precursor capable of forming such a compound.

The light-sensitive materials comprising the emulsions of the invention can be fixed and, if desired, bleached in a conventional manner. The bleaching can be carried out simultaneously with fixing, or separately.

The supersensitizing combinations of the dyes of the invention can be used in a variety of silver halide emulsions used in color or black-and-white light-sensitive materials. Usable emulsions include color positive emulsions, color paper emulsions, color negative emulsions, color reversal emulsions (which may contain color couplers), emulsions used in photographic light-sensitive materials intended for graphic art use (for example, lith type films), emulsions used in light-sensitive materials for recording cathode ray tube displays, emulsions used in X-ray recording materials (particularly those used for direct or indirect photofluorography), emulsions used in colloid transfer processes (such as those described, for example, in U.S. Pat. No. 2,716,059), emulsions used in silver salt diffusion transfer processes (such as those described in U.S. Pat. Nos. 2,352,014, 2,543,181, 3,020,155, 2,861,885, etc.), emulsions used in color diffusion transfer processes (such as those described, for example, in U.S. Pat. Nos. 3,087,817, 3,185,567, 2,983,606, 3,253,915, 3,227,550, 3,227,551, 3,227,552, 3,415,644, 3,415,645 and 3,415,646), emulsions used in dye transfer processes (such as those described, for example, in U.S. Pat. No. 2,882,156), emulsions used in silver dye bleaching processes (as described in Friedman, *History of Color Photography,* Chap. 24, American Photographic Publishers Co., (1944) and *British Journal of Photography,* Vol. 111, pp. 308 - 309 (Apr. 7, 1964)), emulsions used in light-sensitive materials for recording print-out images (such as those described, for example, in U.S. Pat. No. 2,369,449 and Belgian Patent 704,255), emulsions used in photo developable light-sensitive materials (such as those described, for example, in U.S. Pat. Nos. 3,033,682 and 3,287,137), emulsions used in heat developable light-sensitive materials (such as those described, for example, in U.S. Pat. Nos. 3,152,904, 3,312,550 and 3,148,122 and British Patent 1,110,046), emulsions used in physically developable light-sensitive materials (such as those described, for example, in British Patents 920,277 and 1,131,238), and the like.

The supersensitization technique of the invention is particularly useful for preparing emulsions for lith type graphic art light-sensitive materials, multi-layered subtractive color, particularly reversal and negative emulsions, high speed negative emulsions, and emulsions for microfilms.

The effects and advantages attained by the present invention are as follows:

1. A silver halide photographic emulsion can be obtained which has a remarkably high sensitivity to both red and green light and is suitable for use in lith type light-sensitive materials.

2. A orthochromatically sensitized silver halide emulsion can be obtained which has a remarkably high green sensitivity and is suited for use in lith type light-sensitive materials.

3. A silver halide photographic emulsion can be obtained which has a high green sensitivity and reduced color stain and is suited for use as a green-sensitive layer in a color photographic material.

4. A silver halide photographic emulsion can be obtained which has high sensitivity to green light emitted from fluorescent substances and is suited for use in X-ray photosensitive materials.

5. A silver halide photographic emulsion can be obtained which is suited for use in microphotographic materials and has an improved sensitivity to white light and reduced color stain.

6. A silver halide photographic emulsion can be obtained which provides a photographic light-sensitive material having improved stability with the passage of time.

The present invention will be illustrated by the following examples, but the examples are merely illustrative and do not limit the invention.

EXAMPLE 1

A silver chloroiodobromide emulsion containing 0.3 mol% silver iodide and 16.5 mol% silver bromide was prepared in a conventional manner by precipitating silver halide grains by the use of a double jet technique followed by physical ripening, desalting and chemical ripening. The silver halide grains contained in the emulsion had an average grain size of 0.4 $\mu$. The emulsion contained 1.18 mol of silver halide per kg of emulsion.

1 kg of the emulsion was placed in a vessel and melted on a thermostat at 50° C. A definite amount of a methanol solution of the sensitizing dyes of this invention or control sensitizing dyes was incorporated in various samples of the emulsion at 40° C with stirring. To this emulsion were added (with stirring) 20 ml of a 1% by weight of aqueous solution of 4-hydroxy-6-methyl-1,3,3a, 7-tetraazaindene, 10 ml of a 1% by weight aqueous solution of sodium 1-hydroxy-3,5-dichlorotriazine, and then 10 ml of a 1% by weight aqueous solution of sodium dodecylbenzenesulfonate. This finished emulsion was coated on a cellulose triacetate film at a dried thickness of 5 $\mu$ and dried to give a sample.

The sample was cut into strips. One of the strips was further cut into three strips, then each strip was subjected to optical wedge exposure through a blue filter (Wratten 47B), a green filter (Wratten 58) and a red filter (Wratten 25) made by Eastman Kodak Co., respectively, using an actinometer having a light source with a color temperature of 5400° K. The exposure conditions were 256 lux and 1/20 sec. Similar results were observed when the sample was exposed at a high illumination of 10,000 lux for 1/1,000 sec., and little change in the results was seen when samples which had been allowed to stand for 3 days at 50° C at 70% R.H., or for 1 month at 25° C at 60% - 70% R.H., were tested in order to examine the aging stability of the samples. Another strip was exposed using a diffraction grating spectrograph having a light source with a color temperature of 2,666° K to obtain a spectrogram.

The strips were processed for 2 minutes at 20° C in a developing solution of the following composition:

| | |
|---|---|
| Water | 500 ml |
| Monomethyl-p-aminophenol (½ sulfate) | 2 g |
| Sodium sulfite (anhydrous) | 40 g |
| Hydroquinone | 4 g |
| Sodium carbonate (monohydrate) | 28 g |
| Potassium bromide | 1 g |
| Water to make | 1 l |
| (upon use, an equivalent amount of water (1 liter) was added) | |

and then subjected to conventional stopping, fixing and washing to obtain strips having black-and-white images. Densitometric measurements were made on the developed images of each strip using an S-type densitometer made by Fuji Photo Film Co., Ltd., to obtain the blue filter sensitivity (SB), the green filter sensitivity (SG), the red filter sensitivity (SR) and fog. The standard point of optical density used to determine the sensitivity was (fog + 0.20).

The results obtained are shown in Tables 1, 2 and 3.

TABLE 1

| Test No. | Sensitizing Dye and Amount Used × $10^{-5}$ Mol per kg of Emulsion | | | | | | Relative Sensitivity SG | Relative Sensitivity SB | Fog |
|---|---|---|---|---|---|---|---|---|---|
| 1 | | — | | — | | — | — | 100 | 0.04 |
| | (I-6) | 16 | | — | | — | 198 | 131 | 0.04 |
| | | 32 | | — | | — | 264 | 161 | 0.04 |
| | | 64 | | — | | — | 274 | 198 | 0.04 |
| | | 128 | | — | | — | 230 | 142 | 0.06 |
| | | — | (II-15) | 4 | | — | 178 | 103 | 0.04 |
| | | — | | 8 | | — | 264 | 103 | 0.05 |
| | (I-6) | 32 | (II-15) | 4 | | — | 317 | 175 | 0.04 |
| | | 32 | | 8 | | — | 328 | 175 | 0.05 |
| 2 | (I-5) | 8 | | — | | — | 272 | 110 | 0.04 |
| | | 16 | | — | | — | 375 | 114 | 0.04 |
| | (I-5) | 16 | (II-15) | 4 | | — | 446 | 127 | 0.04 |
| | | 16 | | 8 | | — | 495 | 127 | 0.04 |
| 3 | | — | (II-9) | 8 | | — | 110 | 110 | 0.04 |
| | | — | | 16 | | — | 297 | 135 | 0.04 |
| | | — | | 32 | | — | 440 | 155 | 0.04 |
| | (I-8) | 16 | | — | | — | 206 | 135 | 0.04 |
| | | 32 | | — | | — | 260 | 161 | 0.04 |
| | | 64 | | — | | — | 270 | 198 | 0.04 |
| | (I-8) | 32 | (II-9) | 8 | | — | 300 | 178 | 0.04 |
| | | 32 | | 16 | | — | 375 | 185 | 0.04 |
| | | 32 | | 32 | | — | 480 | 185 | 0.04 |
| 4 | | — | (II-11) | 8 | | — | 205 | 136 | 0.04 |
| | | — | | 16 | | — | 375 | 145 | 0.04 |
| | | — | | 32 | | — | 390 | 145 | 0.04 |
| | (I-8) | 32 | (II-11) | 8 | | — | 328 | 172 | 0.04 |
| | | 32 | | 16 | | — | 430 | 180 | 0.04 |
| | | 32 | | 32 | | — | 456 | 180 | 0.04 |
| 5 | (I-14) | 16 | | — | | — | 330 | 132 | 0.04 |
| | | 32 | | — | | — | 430 | 132 | 0.04 |
| | | — | | — | (III-2) | 8 | 330 | 127 | 0.04 |
| | | — | | — | | 16 | 430 | 136 | 0.04 |
| | | — | | — | | 32 | 380 | 130 | 0.04 |
| | (I-14) | 32 | | — | (III-2) | 8 | 485 | 136 | 0.04 |
| | | 32 | | — | | 16 | 485 | 136 | 0.04 |
| 6 | (I-9) | 8 | | — | | — | 300 | 128 | 0.04 |
| | | 16 | | — | | — | 460 | 136 | 0.04 |
| | | 32 | | — | | — | 460 | 136 | 0.04 |
| | | — | | — | (III-3) | 8 | 300 | 136 | 0.04 |
| | | — | | — | | 16 | 460 | 136 | 0.04 |

TABLE 1-continued

| Test No. | Sensitizing Dye and Amount Used × $10^{-5}$ Mol per kg of Emulsion | | | | | | Relative Sensitivity SG | SB | Fog |
|---|---|---|---|---|---|---|---|---|---|
| | (I-9) | 8 | | — | (III-3) | 8 | 430 | 136 | 0.04 |
| | | 16 | | — | | 8 | 510 | 136 | 0.04 |
| 7 | | — | | — | (III-1) | 16 | 258 | 168 | 0.04 |
| | | — | | — | | 32 | 345 | 192 | 0.04 |
| | | — | | — | | 64 | 430 | 210 | 0.06 |
| | (I-9) | 8 | | — | (III-1) | 32 | 430 | 192 | 0.04 |
| | | 16 | | — | | 32 | 480 | 210 | 0.04 |
| 8 | | — | | — | (III-9) | 8 | 53 | 123 | 0.04 |
| | | — | | — | | 16 | 74 | 160 | 0.04 |
| | (I-5) | 8 | | — | (III-9) | 16 | 370 | 142 | 0.04 |
| | | 16 | | — | | 16 | 450 | 160 | 0.04 |
| 9 | (I-17) | 8 | | — | | — | 153 | 110 | 0.04 |
| | | 16 | | — | | — | 240 | 125 | 0.04 |
| | | 32 | | — | | — | 240 | 118 | 0.04 |
| | (I-17) | 8 | | — | (III-2) | 16 | 472 | 148 | 0.04 |
| | | 16 | | — | | 16 | 480 | 148 | 0.04 |
| 10 | (I-6) | 32 | | — | (III-2) | 8 | 453 | 210 | 0.04 |
| | | 32 | | — | | 16 | 470 | 188 | 0.04 |
| 11 | | — | (II-14) | 4 | | — | — | 92 | 0.04 |
| | | — | | 8 | | — | — | 87 | 0.04 |
| | (I-6) | 32 | (II-14) | 4 | | — | 330 | 161 | 0.04 |
| | | 32 | | 8 | | — | 330 | 161 | 0.04 |
| 12 | Control (B) | 32 | | — | Control (C) | 8 | 234 | 100 | 0.04 |
| | | 32 | | — | 16 | 217 | 123 | 0.04 | |
| | | 16 | | — | | 16 | 175 | 127 | 0.04 |

TABLE 2

| Test No. | Sensitizing Dye and Amount Used × $10^{-5}$ Mol per kg of Emulsion | | | | | Relative Sensitivity SR | SB | Fog |
|---|---|---|---|---|---|---|---|---|
| 13 | | — | | — | — | — | 100 | 0.04 |
| | | — | (II-4) | 3 | — | 182 | 100 | 0.04 |
| | | — | | 6 | — | 340 | 93 | 0.04 |
| | (I-8) | 16 | | — | — | — | 137 | 0.04 |
| | | 32 | | — | — | — | 164 | 0.04 |
| | | 64 | | — | — | — | 208 | 0.04 |
| | (I-8) | 16 | (II-4) | 6 | — | 430 | 137 | 0.04 |
| | | 32 | | 6 | — | 445 | 164 | 0.04 |
| 14 | (I-4) | 8 | | — | — | — | 123 | 0.04 |
| | | 16 | | — | — | — | 132 | 0.04 |
| | | 32 | | — | — | — | 127 | 0.04 |
| | (I-4) | 8 | (II-4) | 6 | — | 440 | 123 | 0.04 |
| | | 16 | | 6 | — | 460 | 127 | 0.04 |
| 15 | | — | (II-21) | 8 | — | 380 | 95 | 0.04 |
| | | — | | 16 | — | 472 | 95 | 0.05 |
| | (I-4) | 8 | (II-21) | 16 | — | 519 | 123 | 0.05 |
| | | 16 | | 16 | — | 528 | 136 | 0.05 |
| 16 | | — | (II-3) | 8 | — | 190 | 100 | 0.04 |
| | | — | | 16 | — | 252 | 104 | 0.04 |
| | (I-6) | 16 | (II-3) | 16 | — | 280 | 137 | 0.04 |
| | | 32 | | 16 | — | 288 | 170 | 0.04 |
| | (I-6) | 16 | | — | — | — | 131 | 0.04 |
| | | 32 | | — | — | — | 161 | 0.04 |
| 17 | (I-9) | 8 | | — | — | — | 128 | 0.04 |
| | | 16 | | — | — | — | 136 | 0.04 |
| | (I-9) | 8 | (II-4) | 6 | — | 392 | 128 | 0.04 |
| | | 16 | | 6 | — | 392 | 136 | 0.04 |
| 18 | | — | (II-4) | 6 | Control (A) 8 | 260 | 100 | 0.04 |
| | | — | | 6 | 16 | 253 | 120 | 0.04 |

TABLE 3

| Test No. | Sensitizing Dye and Amount Added ×$10^{-5}$ Mol per kg of Emulsion | | | | | | Type SR | SG | SB | Fog | Stored for 3 Days at 50° C, 70% RH SR | SG | SB | Fog |
|---|---|---|---|---|---|---|---|---|---|---|---|---|---|---|
| 21 | | — | | — | | — | — | — | 100 | 0.04 | — | — | 102 | 0.04 |
| 22 | (I-6) | 24 | (II-1) | 12 | (II-4) | 6 | 656 | 255 | 136 | 0.05 | 680 | 263 | 140 | 0.05 |
| 23 | (I-6) | 32 | (II-21) | 16 | | — | 790 | 437 | 176 | 0.05 | 805 | 445 | 180 | 0.05 |
| 24 | (I-2) | 32 | (II-21) | 16 | | — | 780 | 378 | 176 | 0.05 | 800 | 385 | 180 | 0.05 |
| 25 | (I-6) | 16 | (II-4) | 6 | | — | 304 | 185 | 136 | 0.05 | 307 | 189 | 139 | 0.05 |
| 26 | (I-5) | 16 | (II-4) | 6 | | — | 317 | 317 | 118 | 0.05 | 323 | 323 | 121 | 0.05 |
| 27 | (I-6) | 32 | | — | (III-2) | 16 | — | 470 | 188 | 0.04 | — | 480 | 192 | 0.04 |
| 28 | (I-9) | 16 | | — | (III-1) | 32 | — | 480 | 210 | 0.04 | — | 485 | 214 | 0.04 |

In Table 1, examples of sensitization in the green region of the spectrum are shown. Among the dyes shown in Table 1, those represented by general formula (II) or (III) are known excellent green sensitizing dyes and have been employed in various photographic materials such as color, high speed negative or lith type photographic materials. An additional increase in green sensitivity could be attained without an increase in fogging by using one of these dyes in combination with a dye represented by general formula (I).

Among the dyes shown in Table 2, those represented by general formula (II) are known as red sensitizing dyes. It is clearly shown that the combined use of a dye represented by general formula (II) with a dye represented by general formula (I) improves the sensitivity in the red region of the spectrum. It will be appreciated that the samples of a by the combinations of the invention are superior in both red and green sensitivity to those shown by Test No. 18 in Table 1 in which control dye (A) was employed in the combination.

In Table 3, changes in photographic properties are shown which were determined by exposing strips stored for 3 days at 50° C and 70% R.H. and standard strips stored for 3 days at 23° C and 60 - 65% R.H. followed by processing. Differences in sensitivity between the strips and the standard strips were within 3%, fog showed no increase, and no change in gradation was observed. It can be said that the samples in accordance with the invention are highly stable against the change in temperature and humidity.

EXAMPLE 2

A silver iodobromide emulsion containing 8 mol% silver iodide was prepared by precipitating silver halide grains by the double jet technique followed by physical ripening, desalting and chemical ripening in a conventional manner. The silver halide grains in the emulsion had an average grain size of 0.7 $\mu$. The emulsion contained 0.52 mol of silver halide per kg of emulsion. 1 kg of the emulsion was placed in a vessel, and melted on a thermostatically controlled bath at 50° C.

A definite amount of a methanol solution of each of the sensitizing dyes of the invention was added at 40° C with stirring. To the resultant mixture were added, with stirring, 10 ml of a 0.1% by weight aqueous solution of 4-hydroxy-6-methyl-1,3,3a, 7-tetraazaindene, 10 ml of a 1% by weight aqueous solution of sodium 1-hydroxy-3,5-dichlorotriazine, and 10 ml of a 1% by weight aqueous solution of sodium dodecylbenzenesulfonate. This finished emulsion was coated on a cellulose triacetate film at a dried thickness of 5 $\mu$ to obtain a sample.

The sample was cut into strips. One of the strips was subjected to optical wedge exposure through a blue filter (Wratten 47B) made by Eastman Kodak Co. or a yellow filter (SC-50) made by Fuji Photo Film Co., Ltd. using the same actinometer as in Example 1. The exposure was effected at 1/50 sec. and 64 lux. Another strip was exposed as in Example 1 by the use of the same diffraction grating spectrograph to obtain a spectrogram.

The strips were processed for 7 minutes at 20° C in a developing solution of the following composition:

| | | |
|---|---|---|
| Water | 700 | ml |
| Monomethyl-p-aminophenol (½ sulfate) | 2 | g |
| Sodium sulfite (anhydrous) | 100 | g |
| Hydroquinone | 5 | g |
| Borax (pentahydrate) | 1.5 | g |
| Water to make | 1 | l |

and then subjected to stopping, fixing and washing in a conventional manner to obtain strips having the desired black-and-white images. Densitometric measurements were made by the use of the same densitometer as in Example 1 to obtain the yellow filter sensitivity (SY), the blue filter sensitivity (SB) and fog. The standard point of optical density to determine the sensitivity was (fog + 0.02).

The results obtained are shown in Table 4.

TABLE 4

| Test No. | Sensitizing Dye and Amount Used × $10^{-5}$ Mol per kg of Emulsion | | | | | Relative Sensitivity SY | SB | Fog |
|---|---|---|---|---|---|---|---|---|
| 31 | | — | | — | — | 15 | 100 | 0.04 |
| | (I-17) | 2 | | — | — | 30 | 93 | 0.04 |
| | | 4 | | — | — | 37 | 93 | 0.04 |
| | | — | (II-15) | 2 | — | 97 | 83 | 0.04 |
| | (I-17) | 2 | (II-15) | 2 | — | 120 | 83 | 0.04 |
| | | 4 | | 2 | — | 120 | 83 | 0.04 |
| 32 | (I-2) | 2 | | — | — | 41 | 83 | 0.04 |
| | | 4 | | — | — | 53 | 83 | 0.04 |
| | (I-2) | 2 | (II-15) | 2 | — | 120 | 83 | 0.04 |
| | | 4 | | 2 | — | 124 | 80 | 0.04 |
| 33 | (I-5) | 2 | | — | — | 46 | 83 | 0.04 |
| | | 4 | | — | — | 55 | 73 | 0.04 |
| | | — | (II-10) | 16 | — | 160 | 90 | 0.04 |
| | (I-5) | 2 | (II-10) | 16 | — | 185 | 86 | 0.04 |
| | | 4 | | 16 | — | 185 | 80 | 0.04 |
| 34 | (I-2) | 2 | (II-10) | 16 | — | 185 | 86 | 0.04 |
| | | 4 | | 16 | — | 193 | 83 | 0.04 |
| 35 | | — | (II-9) | 8 | — | 100 | 83 | 0.04 |
| | (I-17) | 2 | (II-9) | 8 | — | 112 | 83 | 0.04 |
| | | 4 | | 8 | — | 142 | 83 | 0.04 |
| 36 | (I-2) | 2 | (II-9) | 8 | — | 115 | 80 | 0.04 |
| | | 4 | | 8 | — | 125 | 80 | 0.04 |
| 37 | | — | (II-2) | 4 | — | 265 | 92 | 0.04 |
| | (I-2) | 2 | (II-2) | 4 | — | 330 | 92 | 0.04 |
| | | 4 | | 4 | — | 330 | 92 | 0.04 |

It will be appreciated from Table 4 that the supersensitizing combinations of the invention are as effective with a silver iodobromide emulsion as they are with a silver chloroiodobromide emulsion as in Example 1.

FIGS. 1 to 4 show spectral sensitivity curves obtained for various samples in the above examples.

FIG. 1 shows the spectral sensitivity curves obtained for the samples corresponding to Test 2 in Table 1, that is, curve 1 represents the spectral sensitivity curve obtained using 16 × $10^{-5}$ mol of dye (I-5) per kg of emulsion, curve 2 represents the spectral sensitivity curve obtained using 4 × $10^{-5}$ mol of dye (II-15) per kg of emulsion, and curve 3 represents the spectral sensitivity curve obtained using 16 × $10^{-5}$ mol of dye (I-5) in combination with 4 × $10^{-5}$ mol of dye (II-15) per kg of emulsion.

Figure 2:
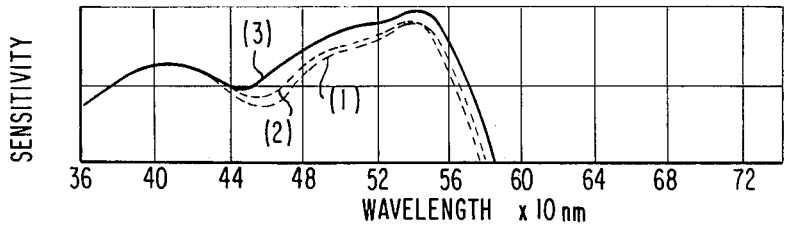

FIG. 2 shows the spectral sensitivity curves obtained for the samples corresponding to Test 6 in Table 1, that is, curve 1 represents the spectral sensitivity curve obtained using 8 × $10^{-5}$ mol of dye (I-9) per kg of emulsion, curve 2 represents the spectral sensitivity curve obtained using 8 × $10^{-5}$ mol of dye (III-3) per kg of emulsion, and curve 3 represents the spectral sensitivity curve obtained using 8 × $10^{-5}$ mol of dye (I-9) in combination with 8 × $10^{-5}$ mol of dye (III-3) per kg of emulsion.

Figure 3:
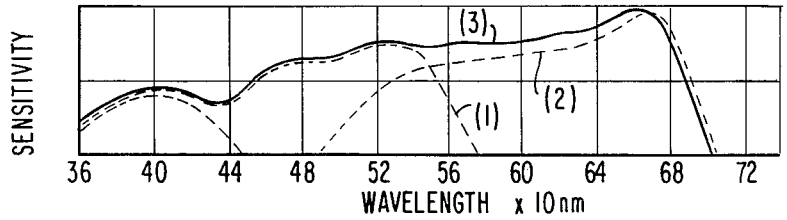

FIG. 3 shows the spectral sensitivity curves obtained for the samples corresponding to Test 15 in Table 2, that is, curve 1 represents the spectral sensitivity curve obtained using 16 × $10^{-5}$ mol of dye (I-4) per kg of emulsion, curve 2 represents the spectral sensitivity curve obtained using 16 × $10^{-5}$ mol of dye (II-21) per kg of emulsion, and curve 3 represents the spectral sensitivity curve obtained using 16 × $10^{-5}$ mol of dye (I-4) in combination with 16 × $10^{-5}$ mol of dye (II-21) per kg of emulsion.

Figure 4:
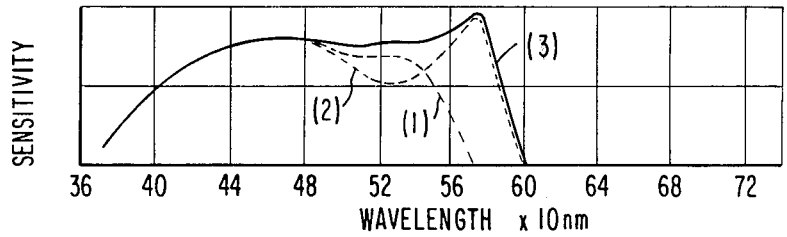
Figure 5:
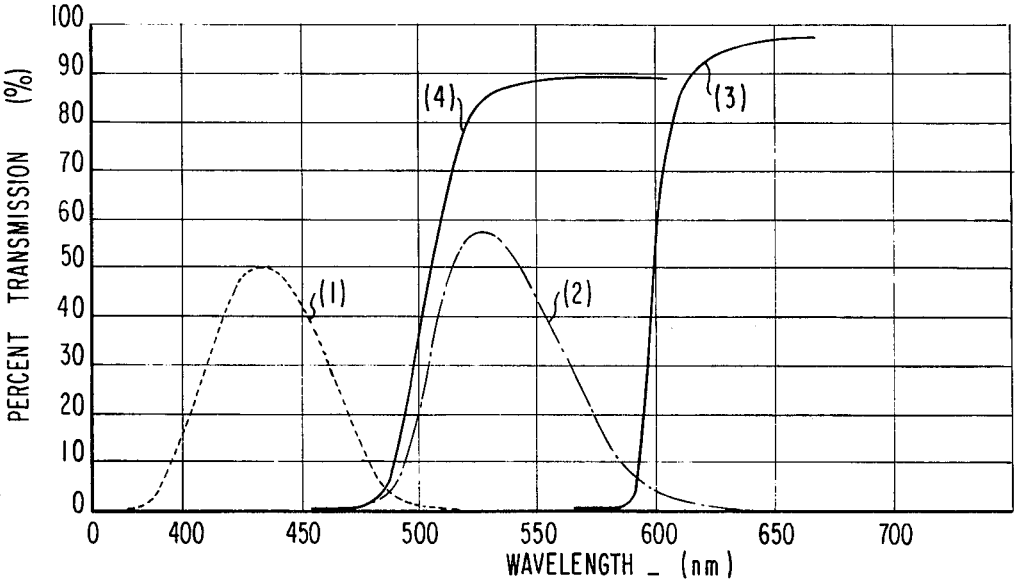
FIG. 5 shows the spectral transmission curves of a Wratten 47B (curve 1), Wratten 58 (curve 2) and SC-50 (curve 4) filter, each of which was used for exposure in the examples described hereinafter.

FIG. 4 shows the spectral sensitivity curves obtained for the samples corresponding to Test 32 in Table 4, that is, curve 1 represents the spectral sensitivity curve obtained using 2 × $10^{-5}$ mol of dye (I-2) per kg of emulsion, curve 2 represents the spectral sensitivity curve obtained using 2 × $10^{-5}$ mol of dye (II-15) per kg of emulsion, and curve 3 represents the spectral sensitivity curve obtained using $2 \times 10^{-5}$ mol of dye (I-2) in combination with $2 \times 10^{-5}$ mol of dye (II-15) per kg of emulsion.

EXAMPLE 3

To 1 kg of an iodochlorobromide emulsion containing 75 mol% silver chloride and 0.2 mol% silver iodide which had been subjected to sulfur sensitization using sodium thiosulfate (10 g of a 0.1 wt % aqueous solution) and gold sensitization using potassium chloroaurate (40 g of a 0.1 wt % aqueous solution) were added $16 \times 10^{-5}$ mol of dye (I-2) and $12 \times 10^{-5}$ mol of dye (II-3). To this mixture were added polyoxyethylene nonylphenyl ether (40 g of a 0.2 wt % aqueous solution) containing 50 ethylene oxide groups and a development promotor (5 g of a 2 wt % aqueous solution) of the following formula:

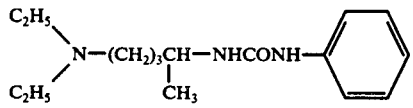

After adding a polybutyl methacrylate latex (100 g of a 20 wt % aqueous solution), the resulting emulsion was coated on a poly(ethylene terephthalate film to obtain a lith type photographic film. This film was designated Sample 41.

A control sample was prepared in a similar manner except that a combination of $12 \times 10^{-5}$ mol of dye (II-1) and $12 \times 10^{-5}$ mol of dye (II-13) was used in place of the combination of dye (I-2) and dye (II-3). This sample was designated Sample 42.

The thus obtained samples were exposed using a magenta contact screen of 150 lines/inch (tungsten lamp of a color temperature of 5,400° K; 256 lux; 1 second exposure), and developed for 1.5 minutes in a developing solution of the following composition:

| | |
|---|---|
| Potassium carbonate | 50 g |
| Potassium bromide | 2 g |
| Sodium ethylenediaminetetraacetate | 1 g |
| Adduct of formaldehyde with sodium bisulfite | 50 g |
| Sodium sulfite | 3 g |
| Boric acid | 7 g |
| Hydroquinone | 18 g |
| Water to make | 1 l |

and stopped and washed in an automatic processor.

Sample 41 was superior in dot quality to Sample 42.

While the invention has been described in detail and with reference to specific embodiments thereof, it will be apparent to one skilled in the art that various changes and modifications can be made therein without departing from the spirit and scope thereof.

What is claimed is:

1. A spectrally sensitized silver halide photographic emulsion containing a supersensitizing amount of a dye combination comprising at least one dye represented by the following general formula (I):

(I)

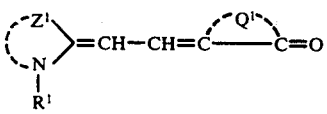

wherein $Z^1$ represents the atoms necessary to complete a benzisoxazole ring; $Q^1$ represents the atoms necessary to complete a 2-thio-oxazolidine-2,4-dione ring, a rhodanine ring or a 2-thiohydantoin ring; and $R^1$ represents an aliphatic group, in combination with at least one cyanine or merocyanine dye which contains no benzisoxazole ring, said cyanine dye which contains no benzisoxazole ring being a dye represented by the following general formula (II):

(II)

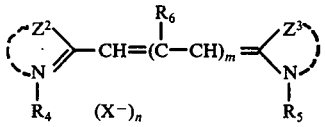

wherein $Z^2$ and $Z^3$ each represents the stoms necessary to complete an imidazole ring, an oxazole ring, a thiazole ring, a selenazole ring, a thiazoline ring, a quinoline ring or an indolenine ring; $R^4$ and $R^5$ each represents an aliphatic group; $R^6$ represents a hydrogen atom, an alkyl group, an aralkyl group or an aryl group; *m* represents 0 or 1; X represents an acid anion; and *n* represents 1 or 2; said merocyanine dye which contains no benzisoxazole ring being a dye represented by the following general formula (III):

(III)

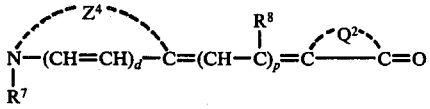

wherein $Z^4$ represents the atoms necessary to complete an oxazole ring, a thiazole ring, a selenazole ring, a thiazoline ring, an imidazole ring, a 2-quinoline ring, a 4-quinoline ring, a pyridine ring, a pyrroline ring, or a tetrazole ring; $Q^2$ represents the atoms necessary to complete a 2-thio-oxazolidine-2,4-dione ring, a rhodanine ring or a 2-thiohydantoin ring; $R^7$ represents an aliphatic group; $R^8$ represents a hydrogen atom, an alkyl group or an aryl group; and *p* and *d* each represents 0 or 1.

2. The spectrally sensitized silver halide photographic emulsion as claimed in claim 1, wherein said cyanine dye which contains no benzisoxazole ring is a dye represented by the following general formula (II):

(II)

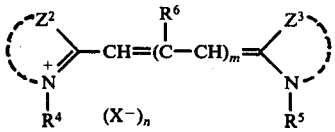

wherein $Z^2$ and $Z^3$ each represents the atoms necessary to complete an imidazole ring, an oxazole ring, a thiazole ring, a selenazole ring, a thiazoline ring, a quinoline ring or an indolenine ring; $R^4$ and $R^5$ each represents an aliphatic group; $R^6$ represents a hydrogen atom, an alkyl group, an aralkyl group or an aryl group; *m* represents 1; X represents an acid anion; and *n* represents 1 or 2.

3. The spectrally sensitized silver halide photographic emulsion as claimed in claim 1, wherein said merocyanine dye which contains no benzisoxazole ring is a dye represented by the following general formula (III):

(III)

-continued

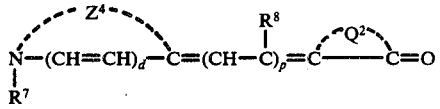

wherein $Z^4$ represents the atoms necessary to complete a 5- or 6-membered heretocyclic ring other than a benzisoxazole ring; $Q^2$ represents the atoms necessary to complete a 2-thiooxazolidine-2,4-dione ring, a rhodanine ring or a 2-thiohydantoin ring; $R^7$ represents an aliphatic group; $R^8$ represents a hydrogen atom, an alkyl group or an aryl group; and *p* and *d* each represents 0 or 1.

4. The spectrally sensitized silver halide photographic emulsion as claimed in claim 1, wherein said cyanine dye which contains no benzisoxazole ring is a dye represented by the following general formula (II-1):

(II-1)

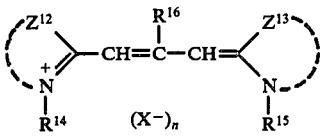

wherein $Z^{12}$ and $Z^{13}$ each represents the atoms necessary to complete a benzimidazole ring, a benzoxazole ring, a naphtho[1,2-d]oxazole ring, a benzothiazole ring, a naphtho[1,2-d]-thiazole ring, a benzoselenazole ring or a naphtho[1,2-d]-selenazole ring; $R^{16}$ represents a hydrogen atom, a methyl group, an ethyl group, a propyl group, a phenyl group, a benzyl group or a phenethyl group; $R^{14}$ and $R^{15}$ each represents an aliphatic group; X represents an acid anion; and n represents 1 or 2.

5. The spectrally sensitized silver halide photographic emulsion as claimed in claim 1, wherein said cyanine dye which contains no benzisoxazole ring is a dye represented by the general formula (II-2):

(II-2)

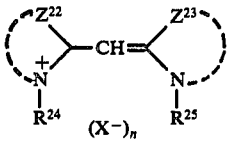

wherein $Z^{22}$ and $Z^{23}$ each represents the atoms necessary to complete a benzimidazole ring, a benzoxazole ring, a naphtho[1,2-d]oxazole ring, a benzothiazole ring, a naphtho[1,2-d]-thiazole ring, a benzoselenazole ring, a naphtho[1,2-d]-selenazole ring or a quinoline ring; $R^{24}$ and $R^{25}$ each represents an aliphatic group; X represents an acid anion; an n represents 1 or 2.

6. The spectrally sensitized silver halide photographic emulsion as claimed in claim 4, wherein at least one of the rings completed by $Z^{12}$ and $Z^{13}$ is a benzimidazole ring, and $R^{14}$ and $R^{15}$ represent an alkyl (the carbon chain of which may be interrupted by an oxygen or sulfur atom), hydroxyalkyl, carboxyalkyl or sulfoalkyl group.

7. The spectrally sensitized silver halide photographic emulsion as claimed in claim 4, wherein each of the rings completed by $Z^{12}$ and $Z^{13}$ is a benzoxazole, naphtho[1,2-d]oxazole, benzothiazole, naphtho[1,2-d]thiazole, benzoselenazole or naphtho[1,2-d]selenazole ring, and at least one of $R^{14}$ and $R^{15}$ is a hydroxyalkyl, carboxyalkyl or sulfoalkyl group.

8. The spectrally sensitized silver halide photographic emulsion as claimed in claim 5, wherein each of the rings completed by $Z^{22}$ and $Z^{23}$ is a benzoxazole, naphtho-[1,2-d]oxazole, benzothiazole, naphtho[1,2-d]thiazole, benzoselenazole or naphtho[1,2-d]selenazole ring, and at least one of $R^{24}$ and $R^{25}$ is a hydroxyalkyl, carboxyalkyl or sulfoalkyl group.

9. The spectrally sensitized silver halide photographic emulsion as claimed in claim 1, wherein $R^1$ is a sulfoalkyl, hydroxyalkyl or carboxyalkyl group, and $Q^1$ is a thiohydantoin ring.

10. The spectrally sensitized silver halide photographic emulsion as claimed in claim 1, wherein said dye shown by general formula (I) is a compound represented by the following general formula (I-1):

(I-1)

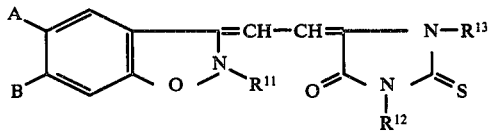

wherein $R^{11}$ and $R^{13}$ each represents an aliphatic group; $R^{12}$ represents an alkyl group, an aryl group or an alkenyl group; and A and B each represents a hydrogen atom, an alkyl group, an aryl group, an alkoxyl group or a hydroxy group.

11. The spectrally sensitized silver halide photographic emulsion as claimed in claim 10, wherein $R^{12}$ is an alkyl, aryl or vinylmethyl group, and $R^{13}$ is an alkyl, hydroxyalkyl, carboxyalkyl, sulfoalkyl, or alkoxyalkyl group.

12. The spectrally sensitized silver halide photographic emulsion as claimed in claim 1, wherein each of $Z^2$ and $Z^3$ represents the atoms necessary to complete a ring selected from the group consisting of a benzoxazole, naphtho[1,2-d]oxazole, benzothiazole, naphtho[1,2-d]thiazole, benzoselenazole or naphtho[1,2-d]selenazole ring, and $R^4$ represents an ethyl group.

13. The spectrally sensitized silver halide photographic emulsion as claimed in claim 1, wherein $Z^2$ represents the atoms necessary to complete a benzimidazole ring, $Z^3$ represents the atoms necessary to complete a benzimidazole, benzoxazole, naphtho[1,2-d]oxazole, benzothiazole, naphtho[1,2-d]thiazole, benzoselenazole or naphtho[1,2-d]selenazole ring, and *m* represents 1.

14. The spectrally sensitized silver halide photographic emulsion as claimed in claim 1, wherein at least one of $R^4$ and $R^5$ is a sulfoalkyl, hydroxyalkyl or carboxyalkyl group.

15. The spectrally sensitized silver halide photographic emulsion as claimed in claim 1, wherein $Z^4$ represents the atoms necessary to complete a thiazoline, benzoxazole, benzothiazole or benzoselenazole ring, $R^5$ is a sulfoalkyl, hydroxyalkyl or carboxyalkyl group, and *p* is 1.

16. The spectrally sensitized silver halide photographic emulsion as claimed in claim 1, wherein $Z^4$ represents the atoms necessary to complete a 2-pyridine, 4-pyridine, benzoxazole, naphtho[1,2-d]oxazole, benzothiazole, naphtho[1,2-d]thiazole, benzoselenazole or naphtho[1,2-d]selenazole ring, $Q^2$ represents the atoms necessary to complete a 2-thiooxazolidine-dione or a rhodanine ring, and $p$ is 0.

17. The spectrally sensitized silver halide photographic emulsion as claimed in claim 1, wherein said merocyanine dye which contains no benzisoxazole ring is a dye represented by the following general formula (III-3):

(III-3)

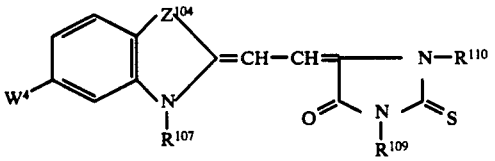

wherein $Z^{104}$ represents an oxygen atom, a sulfur atom or a selenium atom; $W^4$ represents a hydrogen atom, a halogen atom, an alkyl group, an alkoxyl group or a hydroxyl group; $R^{107}$ represents an alkyl group, a hydroxyalkyl group, a carboxyalkyl group or a sulfoalkyl group; $R^{109}$ represents an alkyl group, an aryl group or an alkenyl group; and $R^{110}$ represents an alkyl group, a hydroxyalkyl group, a carboxyalkyl group, a sulfoalkyl group, an alkoxyalkyl group, or an alkoxycarbonylalkyl group.

18. The spectrally sensitized silver halide photographic emulsion as claimed in claim 1, wherein each of said dyes represented by general formula (I) and (II) is incorporated therein at an amount of from $1 \times 10^{-6}$ to $5 \times 10^{-3}$ mol per mol of silver halide in said emulsion.

19. The spectrally sensitized silver halide photographic emulsion as claimed in claim 1, wherein each of said dyes represented by general formula (I) and (II) is incorporated therein at an amount of from $1 \times 10^{-6}$ to $5 \times 10^{-3}$ mol per mol of silver halide in said emulsion, and said dyes are present at an molar ratio of from 1:10 to 10:1.

20. The spectrally sensitized silver halide photographic emulsion as claimed in claim 2, wherein each of said dyes represented by general formula (I) and (II) is incorporated therein at an amount of from $1 \times 10^{-5}$ to $2.5 \times 10^{-3}$ mol per mol of silver halide in said emulsion.

21. The spectrally sensitized silver halide photographic emulsion as claimed in claim 1, wherein each of said dyes represented by general formula (I) and (III) is incorporated therein at an amount of from $1 \times 10^{-6}$ to $5 \times 10^{-3}$ mol per mol of silver halide in said emulsion.

22. The spectrally sensitized silver halide photographic emulsion as claimed in claim 1, wherein each of said sensitizing dyes represented by general formula (I) and (III) is incorporated therein at an amount of from $1 \times 10^{-6}$ mol to $5 \times 10^{-3}$ mol per mol of silver halide in said emulsion, and the molar ratio of the dyes is from 1:10 to 10:1.

23. The spectrally sensitized silver halide photographic emulsion as claimed in claim 1, wherein each of said sensitizing dyes represented by general formula (I) and (III) is incorporated therein at an amount of from $1 \times 10^{-5}$ mol to $2.5 \times 10^{-3}$ mol per mol of silver halide in said emulsion.

24. The spectrally sensitized silver halide photographic emulsion as claimed in claim 1, wherein said silver halide emulsion contains at least 70 mol% silver chloride.

25. The spectrally sensitized silver halide photographic emulsion as claimed in claim 1, wherein said emulsion further contains a color image forming coupler.

26. The spectrally sensitized silver halide photographic emulsion as claimed in claim 25, wherein said coupler is a magenta color image-forming coupler.

27. The spectrally sensitized silver halide photographic emulsion as claimed in claim 5, wherein $Z^{22}$ and $Z^{23}$ each is a benzothiazole ring, a naphtho[1,2-d]thiazole ring or a benzoselenazole ring; and $R^{24}$ and $R^{25}$ is an alkyl, a hydroxyalkyl, a carboxyalkyl or a sulfoalkyl group wherein the alkyl moiety has 1 to 4 carbon atoms.

28. A silver halide light-sensitive material comprising a support having coated thereon at least one silver halide photographic emulsion layer as defined in claim 1.

29. A method of spectrally sensitizing a silver halide photographic emulsion which comprises adding thereto the supersensitizing dye combination of claim 1.

30. The spectrally sensitized silver halide photographic emulsion of claim 1, wherein said dye represented by formula (I) is in combination with said cyanine dye.

31. The spectrally sensitized silver halide photographic emulsion of claim 1, wherein said dye represented by formula (I) is in combination with said merocyanine dye.

* * * * *